US007646282B2

(12) United States Patent
Pazdirek

(10) Patent No.: US 7,646,282 B2
(45) Date of Patent: Jan. 12, 2010

(54) INSULATOR FOR CUTOUT SWITCH AND FUSE ASSEMBLY

(76) Inventor: Jiri Pazdirek, 233 Stockport La., Schaumberg, IL (US) 60193

( * ) Notice: Subject to any disclaimer, the term of this patent is extended or adjusted under 35 U.S.C. 154(b) by 272 days.

(21) Appl. No.: 12/002,025

(22) Filed: Dec. 14, 2007

(65) Prior Publication Data

US 2009/0153286 A1 Jun. 18, 2009

(51) Int. Cl.
*H01H 85/042* (2006.01)
*H01H 85/30* (2006.01)

(52) U.S. Cl. ..... 337/172; 337/171; 337/174; 337/187; 337/202; 337/246

(58) Field of Classification Search ..... 337/171, 337/172, 174, 187, 202, 246; 361/104; 242/360
See application file for complete search history.

(56) References Cited

U.S. PATENT DOCUMENTS

| | | | | | |
|---|---|---|---|---|---|
| 1,158,019 | A | | 10/1915 | Anderson | |
| 1,691,330 | A | | 11/1928 | Austin | |
| 1,939,371 | A | * | 12/1933 | Spurgeon | 337/31 |
| 1,953,136 | A | | 4/1934 | Steinmayer | |
| 1,967,654 | A | | 7/1934 | Austin | |
| 1,980,476 | A | | 11/1934 | Earle | |
| 2,049,552 | A | | 8/1936 | Walsh | |
| 2,074,913 | A | * | 3/1937 | Johnson | 337/172 |
| 2,088,415 | A | * | 7/1937 | Heinrich | 337/176 |
| 2,174,476 | A | | 9/1939 | Pittman et al. | |
| 2,230,955 | A | * | 2/1941 | Johnson | 337/170 |
| 2,324,888 | A | * | 7/1943 | Strobel | 337/180 |
| 2,357,772 | A | * | 9/1944 | Schultz | 337/173 |
| 2,398,469 | A | | 4/1946 | Schultz et al. | |
| 2,549,635 | A | | 4/1951 | Pittman | |
| 2,584,586 | A | * | 2/1952 | Hubbard | 337/170 |
| 2,776,332 | A | | 1/1957 | Von Cron | |
| 2,821,604 | A | | 1/1958 | Wallace | |
| 2,835,764 | A | | 5/1958 | Earle | |
| 2,836,681 | A | | 5/1958 | Bracey | |
| 2,862,080 | A | * | 11/1958 | Yonkers | 337/177 |
| 2,910,560 | A | * | 10/1959 | Stroup et al. | 337/174 |
| 2,961,518 | A | | 11/1960 | Hermann | |
| 2,986,619 | A | | 5/1961 | McCloud | |
| 3,218,517 | A | | 11/1965 | Sankey | |
| 3,235,688 | A | | 2/1966 | Fink et al. | |
| 3,249,719 | A | | 5/1966 | Misare et al. | |
| 3,377,420 | A | | 4/1968 | Brown et al. | |
| 3,448,343 | A | | 6/1969 | Kershaw, Jr. | |
| 3,512,118 | A | | 5/1970 | Leonard | |
| 3,522,366 | A | | 7/1970 | Lambeth | |

(Continued)

FOREIGN PATENT DOCUMENTS

WO WO 9326015 A1 * 12/1993

*Primary Examiner*—Anatoly Vortman
(74) *Attorney, Agent, or Firm*—Dana Andrew Alden

(57) ABSTRACT

An insulator for a cutout switch and fuse assembly used in connection with an electrical power grid, including a body including a first end and a second end, a guide connector, a conductor strip, and a tool structure is located, a pivot connector is located at the second end of the body, and a mounting connector is located on the body between the first end and the second end. In an alternative embodiment, universal connectors are located at the first end and the second end. The body is manufactured by a filament winding process.

14 Claims, 29 Drawing Sheets

U.S. PATENT DOCUMENTS 3,544,707 A * 12/1970 Gamble ..... 174/142
3,585,274 A 6/1971 Tomaszewski et al.
3,594,676 A 7/1971 Misare
3,663,333 A 5/1972 Palfreyman
3,673,305 A 6/1972 Mashikian et al.
3,730,970 A 5/1973 Johnson
3,808,352 A * 4/1974 Johnson ..... 174/73.1
3,810,060 A 5/1974 Hubbard
3,868,615 A 2/1975 Haubein et al.
3,880,693 A 4/1975 Urlings et al.
3,898,372 A * 8/1975 Kalb ..... 174/179
3,952,848 A 4/1976 Walker et al.
4,053,707 A 10/1977 Ely et al.
4,198,538 A 4/1980 Lusk
4,212,696 A 7/1980 Lusk et al.
4,217,466 A * 8/1980 Kuhl ..... 174/209
4,243,628 A * 1/1981 Herold ..... 264/275
4,246,696 A 1/1981 Bauer et al.
4,267,402 A 5/1981 Reighter
4,272,751 A * 6/1981 Biller et al. ..... 337/231
4,296,276 A * 10/1981 Ishihara et al. ..... 174/179
4,308,566 A 12/1981 Imataki et al.
4,317,099 A * 2/1982 Sabis ..... 337/170
4,326,184 A * 4/1982 Murdock ..... 337/168
4,331,833 A 5/1982 Pargamin et al.
4,373,113 A * 2/1983 Winkler et al. ..... 174/179
4,386,250 A 5/1983 Nicoloso
4,390,745 A 6/1983 Bottcher et al.
4,414,527 A * 11/1983 Biller ..... 337/180
4,440,975 A 4/1984 Kaczerginski
4,540,968 A 9/1985 Kato et al.
4,546,341 A 10/1985 McNaghten et al.
4,609,798 A 9/1986 Nicoloso
4,710,847 A 12/1987 Kortschinski et al.
4,714,800 A 12/1987 Atkins et al.
4,724,284 A * 2/1988 Wheeler ..... 174/152 R
4,768,010 A * 8/1988 Brown et al. ..... 337/169
4,774,488 A 9/1988 Field
4,857,879 A * 8/1989 Morgan ..... 337/173
4,864,455 A 9/1989 Shimomura et al.
4,870,387 A 9/1989 Harmon
4,870,687 A 9/1989 DeLeon
5,128,648 A 7/1992 Brandi
5,220,134 A * 6/1993 Novel et al. ..... 174/179
5,233,132 A * 8/1993 Soucille ..... 174/179
5,300,912 A 4/1994 Tillery et al.
5,374,780 A * 12/1994 Pazdirek ..... 174/176
5,389,742 A * 2/1995 Clabburn et al. ..... 174/209
5,406,033 A * 4/1995 Pazdirek ..... 174/176
5,502,427 A * 3/1996 Scherer et al. ..... 337/176
5,540,991 A * 7/1996 Hayakawa et al. ..... 428/370
5,563,379 A * 10/1996 Kunieda et al. ..... 174/169
5,612,661 A * 3/1997 Twenter et al. ..... 337/169
5,633,478 A * 5/1997 Ishino ..... 174/179
5,877,453 A * 3/1999 Hill ..... 174/179
5,925,855 A * 7/1999 Denndorfer ..... 174/179
5,945,636 A * 8/1999 Sakich et al. ..... 174/174
5,973,272 A * 10/1999 Levillain et al. ..... 174/179
5,986,216 A * 11/1999 Krause ..... 174/179
6,031,186 A * 2/2000 Sakich et al. ..... 174/167
6,065,207 A * 5/2000 Fujii et al. ..... 29/887
6,215,075 B1 * 4/2001 Pazdirek ..... 174/178
6,462,639 B1 * 10/2002 Farag et al. ..... 337/172
6,583,708 B1 * 6/2003 Smith et al. ..... 337/169
6,952,154 B2 * 10/2005 Almgren et al. ..... 337/202
6,972,378 B2 * 12/2005 Schomer et al. ..... 174/142
7,180,004 B2 * 2/2007 Barker et al. ..... 174/179
7,532,103 B2 * 5/2009 Almgren et al. ..... 337/202
2001/0040046 A1 * 11/2001 Hoefner ..... 174/158 R
2002/0153163 A1 * 10/2002 Portas et al. ..... 174/209
2002/0158745 A1 * 10/2002 Haynam et al. ..... 337/171
2003/0231097 A1 * 12/2003 Almgren et al. ..... 337/171
2004/0239473 A1 * 12/2004 Van Heerden ..... 337/171
2005/0034892 A1 * 2/2005 Philips et al. ..... 174/137 A
2005/0067185 A1 * 3/2005 Schomer et al. ..... 174/142
2005/0104709 A1 * 5/2005 Montante ..... 337/171
2005/0178579 A1 * 8/2005 Schomer et al. ..... 174/138 F
2005/0280496 A1 * 12/2005 Almgren et al. ..... 337/202
2006/0005993 A1 * 1/2006 Almgren et al. ..... 174/142

* cited by examiner

INSULATOR FOR CUTOUT SWITCH AND FUSE ASSEMBLY

FIELD OF THE INVENTION

The present invention relates to insulators and cutout switches fore use with fuse assemblies to protect power distribution grids.

BACKGROUND OF THE INVENTION

Electrical cutouts are known in the art and are employed in electrical power distribution grids. Electrical cutouts protect power distribution grids from damage due to electrical surges. If an electrical surge occurs within an electrical power distribution grid, an electrical cut out is blown. Accordingly, electrical power is cut-off from the electrical power distribution grid; thereby, protecting the electrical power distribution grid from damage.

An electrical cutout includes a fuse that blows when a surge of electricity is passed through the fuse. When a fuse in fuse cutout is blown, a physical force is exerted on the insulator. As such, the insulators must be able to withstand the force resulting on the blown fuse.

Insulators made from porcelain and ceramic have been designed; however, porcelain and ceramic insulators are heavy and bulky. Further, porcelain and ceramic insulators chip easily and are brittle. U.S. Pat. No. 6,392,526 to Roberts et al. entitled "Fuse Cutout with Mechanical Assist," the disclosure of which is incorporated herein by reference, illustrates a porcelain insulator and a fuse assembly. As shown in FIG. 1 therein, the fuse assembly 16 is secured to the porcelain insulator by the support members 32 and 34. As depicted in FIGS. 4 and 6 therein, when the fuse is blown, the fuse assembly 16 rotates on the trunnion 24 about pivot point 137 and exerts a force on the porcelain insulator. This force can damage the ridged porcelain insulator thereby resulting in a chipped or weak structure.

Other problems have arisen with electrical cutouts. One such problem occurs when electricity flashes directly from a conducting surface to a grounded surface while the fuse assembly is in the open or closed position. This phenomenon is referred to as "flashover." The electricity travel gap between the conducting surface and the grounded surface is called the "strike distance."

Another problem with conventional cutouts occurs when the electrical current travels or "creeps" along the surface of the insulator, bypassing the fuse assembly. "Creep" results when the insulator has an inadequate surface distance. This may occur when water, dirt, debris, salts, air-borne material, and air pollution is trapped at the insulator surface and provide an easier path for the electrical current. This surface distance may also be referred to as the "leakage," "tracking," or "creep" distance of a cutout.

Because of these problems, cutouts must be made of many different-sized insulators. Cutouts are made with numerous insulator sizes that provide different strike and creep distances, as determined by operating voltages and environmental conditions. The strike distance in air is known, thus insulators must be made of various sizes in order to increase this distance and match the appropriate size insulator to a particular voltage. Creep distance must also be increased as voltage across the conductor increases so that flashover can be prevented.

Cutouts with plastic or polymeric insulators have been designed; however, such insulators are of complicated design and labor-intensive manufacture. Examples of such cutouts include U.S. Pat. No. 5,300,912 to Tillery et al., entitled "Electrical Cutout for High Voltage Power Lines," the disclosure of which is incorporated herein by reference. However, Tillery et al. utilizes an injection-molded insulator with a complicated non-solid cross-sectional configuration (Col. 6, II. 20-22) with skirts mounted thereon (Col. 4, II. 53-54).

Therefore, there exists a need for simple design that facilitates ease in the manufacture of the many different-sized cutouts and insulators the electrical power industry requires. There also exists a need for a lighter insulator that allows for greater ease in handling and shipping. Further, there exists a need for an insulator, which will chip or break when a fuse is blown and which can withstand the tension forces exerted by electric power lines.

SUMMARY OF THE INVENTION

The scope of the present invention is defined solely by the appended claims, and is not affected to any degree by the statements within this summary. Briefly stated, a cut out assembly embodying features of the present invention comprises a body with a first end and as second end. A mounting connector is located on the body between the first end and the second end. A guiding connector, a conducting strip, and a tool structure are located at the first end of the body, and a pivot connector is located at the second end of the body. In alternative embodiments, universal connectors are located at the first end and second end of the body. The connectors are manufactured in a multi-station press out of sheet metal, such as grade 1010 sheet metal. The body is manufactured by winding a fiber on a spool in a process known as filament winding.

DETAILED DESCRIPTION OF THE PRESENTLY PREFERRED EMBODIMENTS

Figure 1:
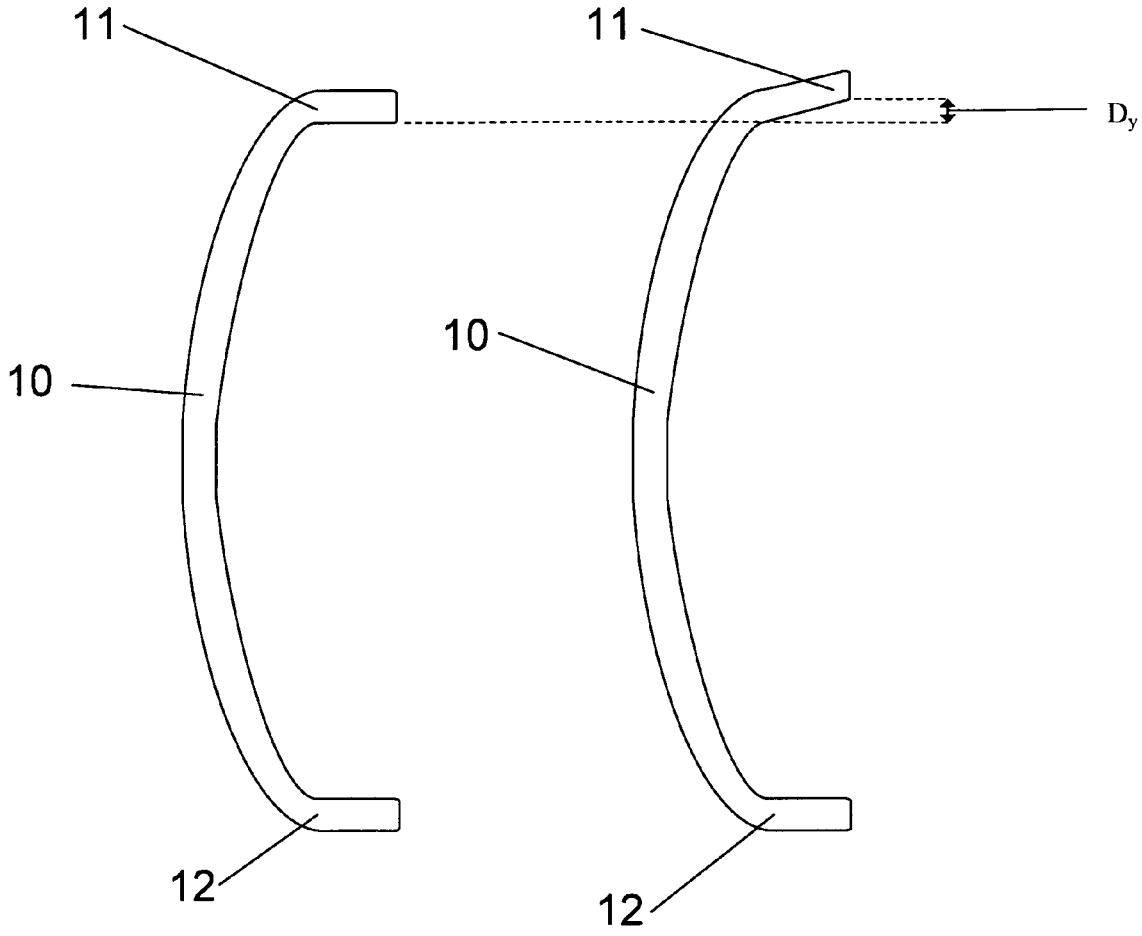
FIG. 1 depicts a cross-sectional view of an embodiment of the body flexing in a direction $D_y$.

Turning now to FIG. 1, a preferred embodiment of the body 10 of the present invention is shown. As shown therein, the body 10 is provided with a first end 11 and a second end 12. The body 10 includes a plurality of glass fibers, oriented so the body 10 is flexible. In the presently preferred embodiment, the body 10 is configured to flex so as to allow the fuse assembly 70 to disengage. Advantageously, the body 10 is structured to flex so as to allow the ends 11, 12 to extend a distance from each other, referred to herein as $D_y$.

Figure 2:
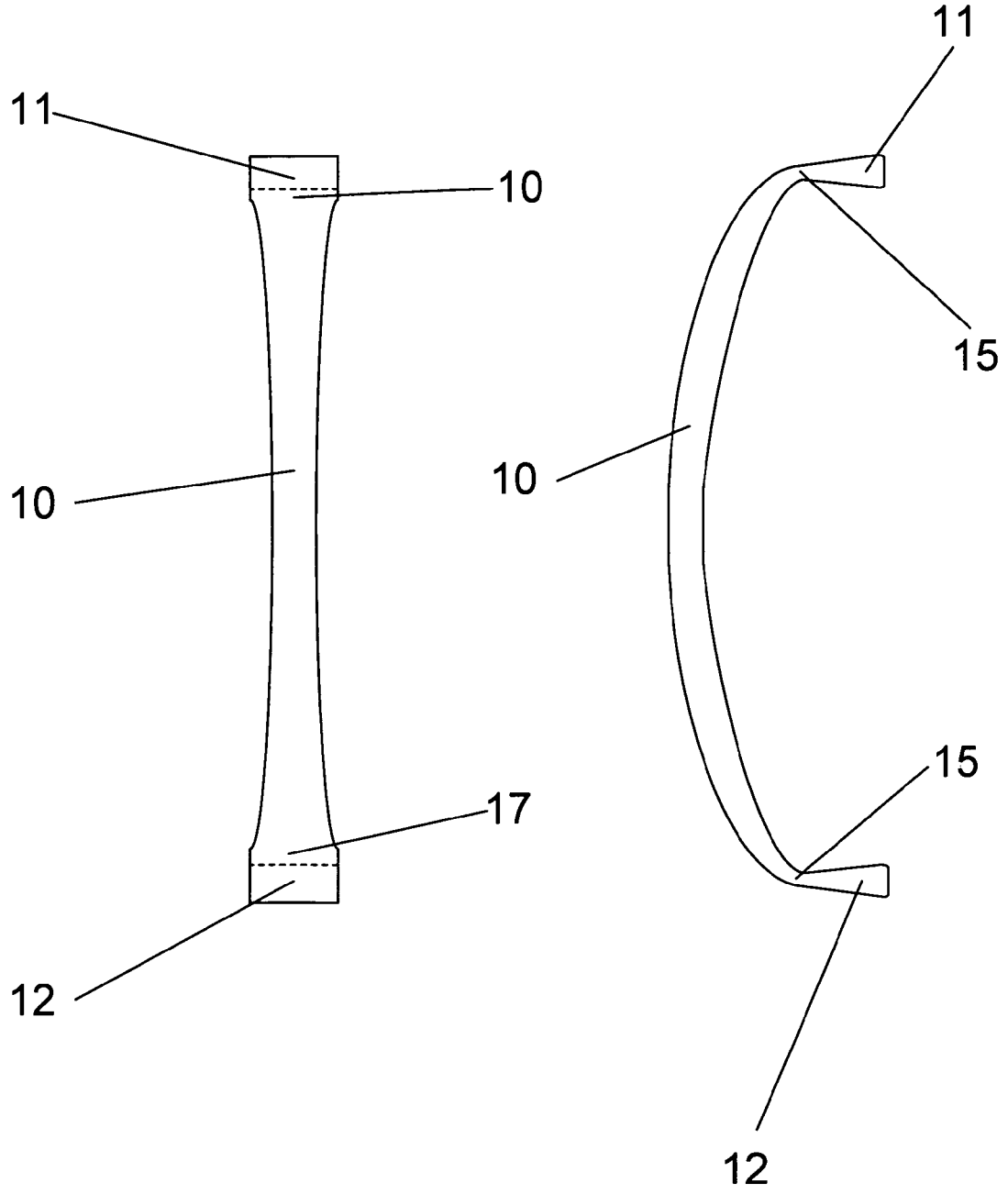
FIG. 2 depicts a front view of an embodiment of the body and a cross-sectional view of the one embodiment of the body.
Figure 3:
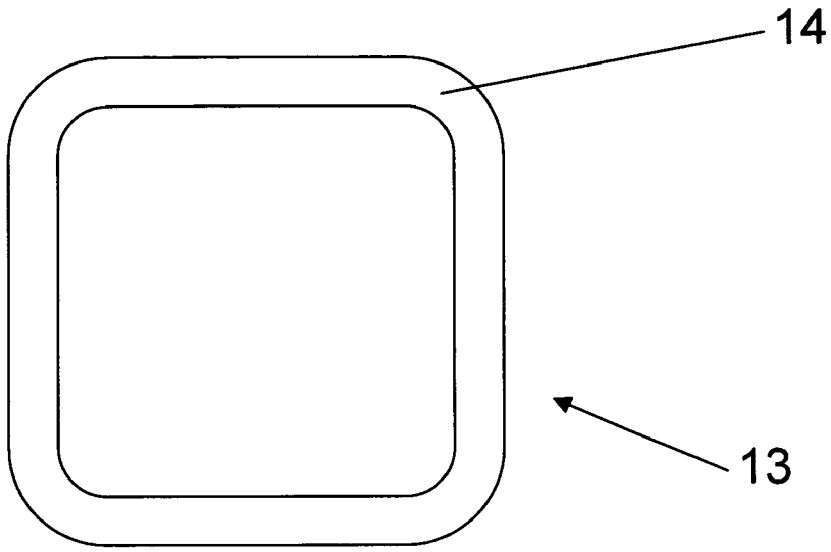
FIG. 3 depicts a cross-sectional view of a spool.
Figure 4:
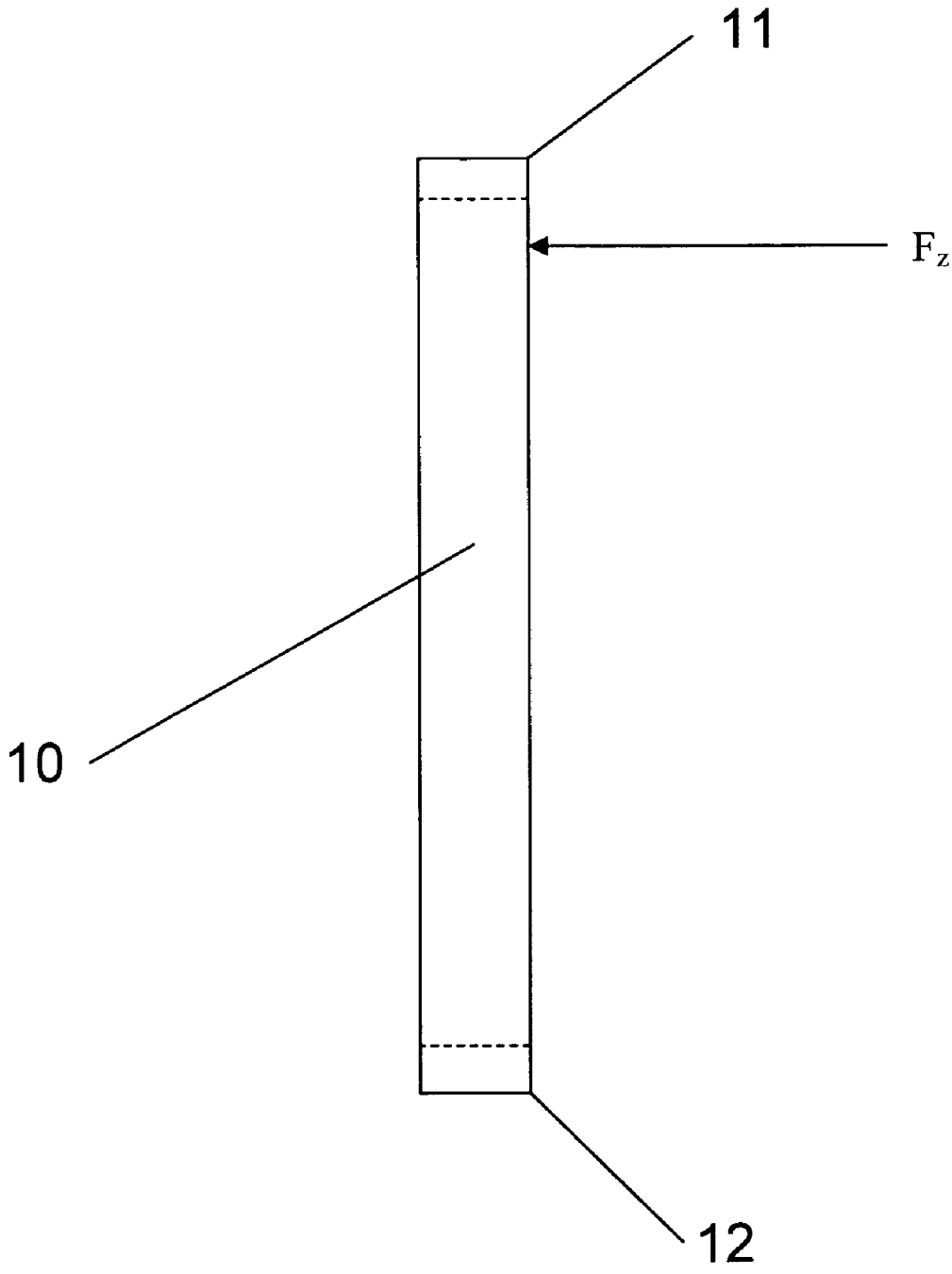
FIG. 4 depicts a front view of an embodiment of the body.
Figure 5:
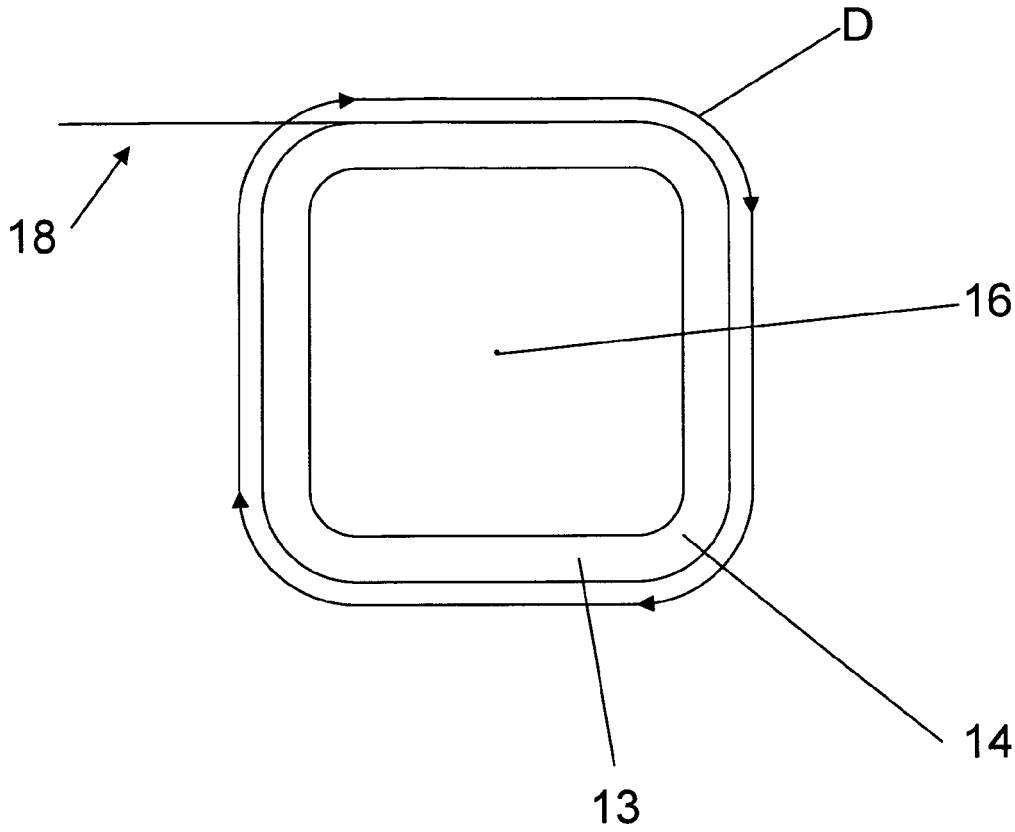
FIG. 5 depicts a cross-sectional view of the spool that is spun about an axis.

Referring now to FIG. 2, the body 10 is provided with a cross-sectional shape. The cross-sectional shape varies along the body 10, from the first end 11 to the second end 12. During manufacture, a spool 13 is utilized. Advantageously, the spool 13 is provided with an angled portion 14. As shown in FIG. 5 the spool 13 pulls a fiber 18 that has been impregnated with epoxy resin. At the angled portion 14 of the spool 13, the fiber 18 is more tightly wound around the spool 13 so that the body 10 is provided with a reduced cross-sectional profile 15. The reduced cross-sectional profile 15 enables the body to flex so that the first end 11 extends from the second end 12 while at the same time providing rigidity and structural strength when a force $F_z$ is applied in other directions, as is illustrated in FIG. 4.

During manufacture of the body 10, a torsional movement is imparted to the spool 13, so that the spool 13 is spun about an axis 16 (shown in FIG. 5 extending from the page). As FIG. 5 illustrates, the spool 13 is spun in a direction D that enables the fiber 18 to be wound around the spool 13. In an alternative arrangement, axial movement can be imparted to the spool 13, in addition to the torsional movement about the axis 16, so that fibers 18 can be oriented to provide the body 10 with varying cross-sectional profiles. By way of example, and not limitation, the body 10 can be provided with a wider profile 17, in a predetermined dimension and, at the same time, narrower in other cross-sectional dimensions, as shown in FIG. 2.

Referring now to FIG. 2, the first end 11 of the body 10 and the second end 12 of the body 10 extend in a generally parallel direction from the body 10. In one embodiment, the cross-sectional area of the body 10 decreases at the reduced cross-sectional profile 15; thereafter, the cross-sectional area of the first end 11 and the second end 12 increases as the first end 11 and second end 12 extend, in a generally parallel orientation, from the body 10. In another embodiment, and in a similar vein, the cross-sectional profile of the body 10 decreases at the reduced cross-sectional profile 15, and then increases as the first end 11 and the second end 121 extend, in a generally parallel orientation, from the body 10.

Figure 21:
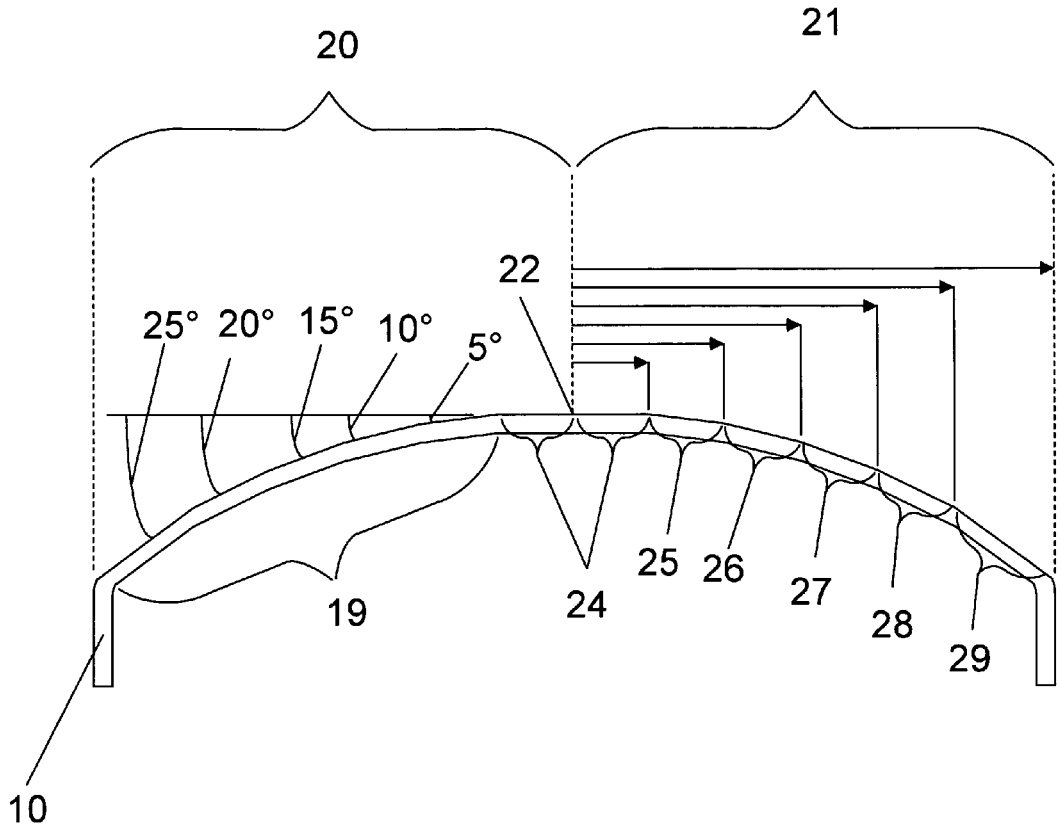
FIG. 21 depicts a cross-sectional view of an embodiment of the body.

Turning now to FIG. 21, the presently preferred body 10 is shown. As illustrated, the body 10 is provided with a shape that prevents air from being trapped within the wound fibers. Advantageously, the body 10 is provided with a generally elliptical shape with a plurality of angled portions 19. The body 10, shown in FIG. 21, is provided with a first arm 20 and a second arm 21. Each arm extends from the midpoint 22 of the body 10 to an end 23 and is provided with a generally straight portion 24. Each arm is also provided with a first angled portion 25, a second angled portion 26, a third angled portion 27, a fourth angled portion 28, and a fifth angled portion 29. The angled portions of the first arm 20 are equally dimensioned to the corresponding angled portions of the second arm 21 so that the first angled portion 25 of the first arm 21 has the same physical dimensions as the first angled portion 25 of the second arm 21. In the same vein, the second angled portion 26 of the first arm 20 is provided with the same physical dimensions as the second angled portion 26 of the second arm 21; thus, the third angled portion 27, the fourth angled portion 28, and the fifth angled portion 29 are dimensioned in the first arm 20 and second arm 21 respectively.

In the presently preferred embodiment, the first angled portion 25 is dimensioned between 1.04 to 1.10 inches (and preferably 1.07 inches) from the midpoint and is provided with an angle the measures 5 degrees relative to the generally straight portion 24 of the body 10. The second angled portion 26 is between 1.89 and 1.95 inches (and preferably 1.92 inches) from the midpoint 22 and is provided with an angle the measures 10 degrees relative to the generally straight portion 24 of the body 10. The third angled portion 27 is between 2.80 and 2.88 inches (and preferably 2.84 inches) from the midpoint 22 and is provided with an angle that measures 15 degrees relative to the generally straight portion 24 of the body 10. The fourth angled portion 28 is between 4.00 and 4.10 inches (and preferably 4.05 inches) from the midpoint 22 and is provided with angle that measures 20 degrees relative to the generally straight portion 24 of the body 10. The fifth angled portion 29 is between 4.71 and 4.83 inches (and preferably 4.77 inches from the midpoint 22 and is provided with an angle that measures 25 degrees relative to the generally straight portion 24 of the body 10.

Figure 18:
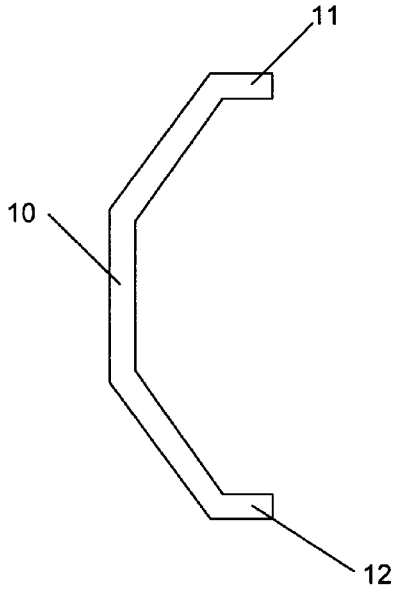
FIG. 18 depicts a cross-sectional view of an embodiment of the body.
Figure 19:
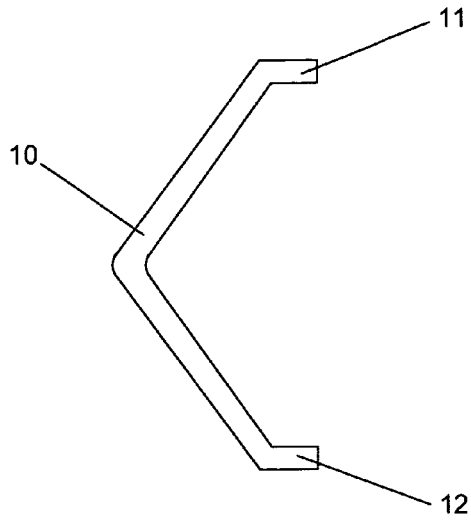
FIG. 19 depicts a cross-sectional view of an embodiment of the body.
Figure 20:
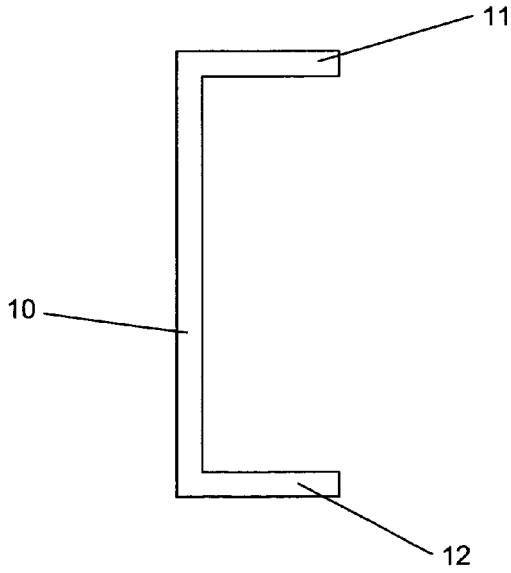
FIG. 20 depicts a cross-sectional view of an embodiment of the body.

While the presently preferred embodiment is generally elliptical in shape, as FIG. 1 illustrates, the body 10 may be made in other shapes as well. By way of example, and not limitation, the body 10 is generally octagonal in shape, as shown in FIG. 18. In another alternative embodiment, the body 10 is hexagonal in shape, as shown in FIG. 19. In yet another alternative embodiment the body 10 is generally rectangular in shape, as is shown in FIG. 20.

Figure 24:
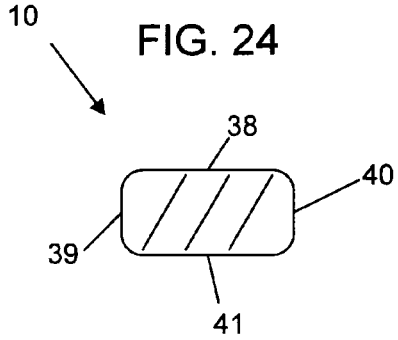
FIG. 24 depicts a cross-sectional view of an embodiment of the body.
Figure 25:
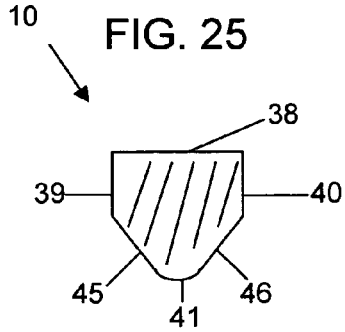
FIG. 25 depicts a cross-sectional view of an embodiment of the body.
Figure 26:
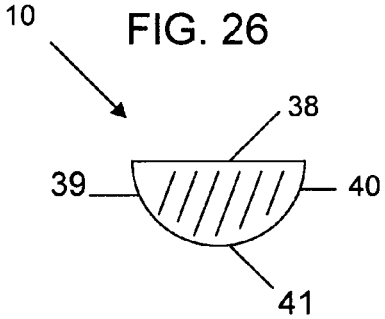
FIG. 26 depicts a cross-sectional view of an embodiment of the body.

Referring now to FIG. 24, the cross-sectional shape of the body 10 is shown. As illustrated, the cross-sectional shape is generally rectangular in shape. However, in other embodiments, the cross-sectional shape is provided with a plurality of angled surfaces 45, 46. In yet another alternative embodiment, the cross-sectional shape is circular. As FIGS. 24, 25, and 26 show, the cross-sectional shape of the body 10 is provided with a fuse side 41, a first side wall 39, a second side wall 40, and a mounting side 38.

Figure 28:
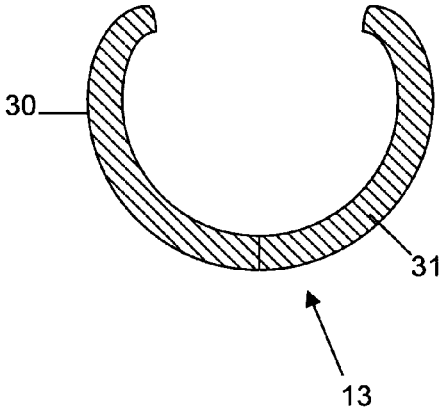
FIG. 28 depicts a cross-sectional view of an embodiment of the spindle.
Figure 29:
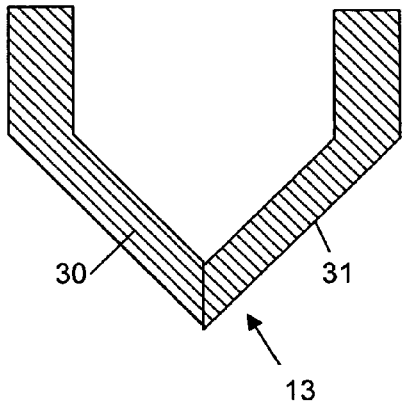
FIG. 29 depicts a cross-sectional view of an embodiment of the spindle.

Those skilled in the art will appreciate that the cross-sectional shape is created through use of the spool 13. More specifically, the spool 13 is shaped according to the desired cross-sectional shape to be given the body 10. Thus, as shown in FIG. 28, the spool 13 is shaped to provide the body 10 with an elliptical cross-sectional shape. As shown in FIG. 29, the spool 13 is shaped to provide the body 10 with a plurality of angled surfaces 45, 46.

Figure 27:
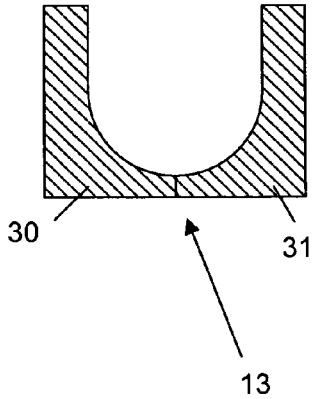
FIG. 27 depicts a cross-sectional view of an embodiment of the spindle.

FIGS. 27, 28, 29 illustrate the spool (or mandrel) 13 is shaped to provide the body 10 with the first side wall 39, the second side wall 40, and the fuse side 41. The symmetric cross-sectional shape of the body 10 is utilized in its manufacture. As FIGS. 27, 28, 29 illustrate a plurality of pieces (preferably a first piece 30 and a second piece 31). The first piece 30 and the second piece 32 are joined at a location where the fuse side 41 is divided in half. Thus, the first piece 30 and the second piece 31 are identical in shape (except insofar as the first piece 30 is carried on the spindle 44 as will be explained later herein).

The presently preferred embodiment is manufactured through a process referred to as filament winding. An insulating fiber 18 is impregnated with an epoxy resin. In the presently preferred embodiment, the fiber 18 is glass. In an alternative embodiment, the fiber 18 is an aramid; in another alternative embodiment the fiber 18 is polyester. In yet another alternative embodiment, the fiber 18 is a combination of one or more of an aramid, a polyester, or a glass.

Figure 30:
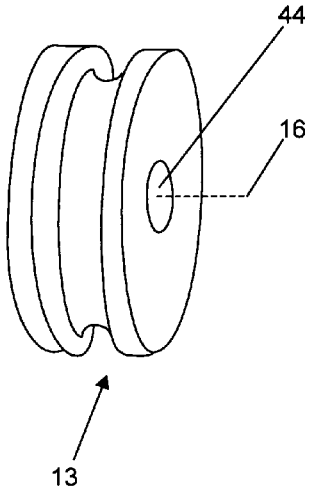
FIG. 30 depicts a perspective view of an embodiment of the spindle.

The process of filament winding begins by placing a single strand of resin-impregnated fiber 18 on the spool 13. The spool 13 is attached to a spindle 44 which rotates the spool 13 about an axis 16. As the spool 13 is rotated, the strand of resin-impregnated fiber 18 is wound around the spool 13. FIG. 30 depicts the preferred spool (or mandrel) 13.

After the resin-impregnated fiber 18 is wound around the spool 13, the resin-impregnated fiber 18 is cured. In the presently preferred embodiment, the epoxy resin is cured by exposing the wound filaments to UV-light. However, in alternative embodiments, the epoxy-resin is cured by exposing the epoxy-resin to heat, such as in an oven.

Figure 31:
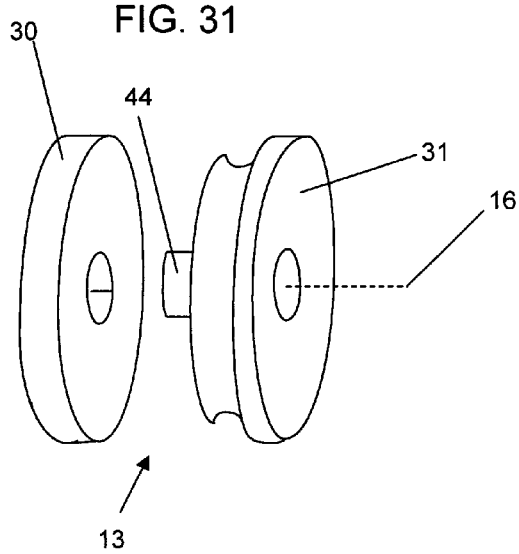
FIG. 31 depicts a perspective view of an embodiment of the spindle.

After the epoxy-resin has been cured, the composite material is removed from the spool or mandrel 13. As FIG. 31 illustrates, the spool 13 is in a plurality of pieces, a first piece 30 and a second piece 31. To remove the composite material from the spool 13, the first piece 30 is separated from the second piece 31. Referring again to FIG. 31, the first piece 30 is carried on the spindle 44 and is dimensioned according to the first side wall 39 of the body 10, and at least in part, the fuse side 41 of the body 10 (preferably half of the fuse side 41). As FIGS. 31 and 32 illustrate, the spindle 13, the first piece 30, and the second piece 31 are co-axial about an axis 16 of rotation.

Figure 32:
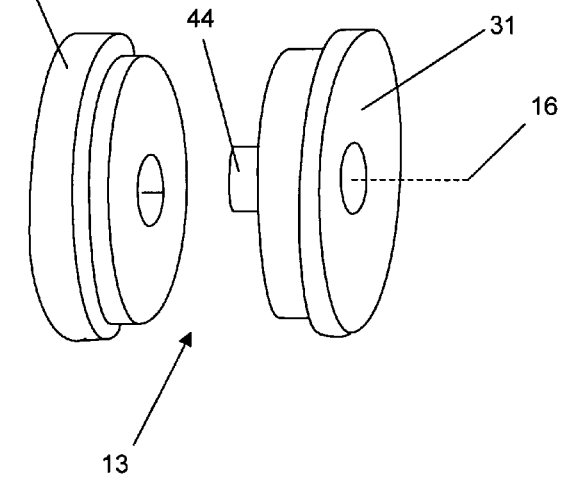
FIG. 32 depicts a perspective view of an embodiment of the spindle.

As FIG. 32 illustrates, the spindle 13 and the second piece 31 are integrated while the first piece 30 is coupled to the second piece 31 and carried on the spindle 44. However, in alternative embodiments, the spindle 44 is independent of the second piece 31 and carries both the first piece 30 and the second piece 31. Advantageously, the spindle 44 may be shaped to transmit torque to the first piece 30 and the second piece 31. For example, the spindle 13 may be geared or splined (preferably to correspond to the first piece 30 and the second piece 31). Therefore, removal of the composite material from the spool 13 simply requires that the first piece 30 and the second piece 31 be separated. In the presently preferred embodiment, the first piece 30 is removed from the second piece 31 and the spindle 44.

Figure 33:
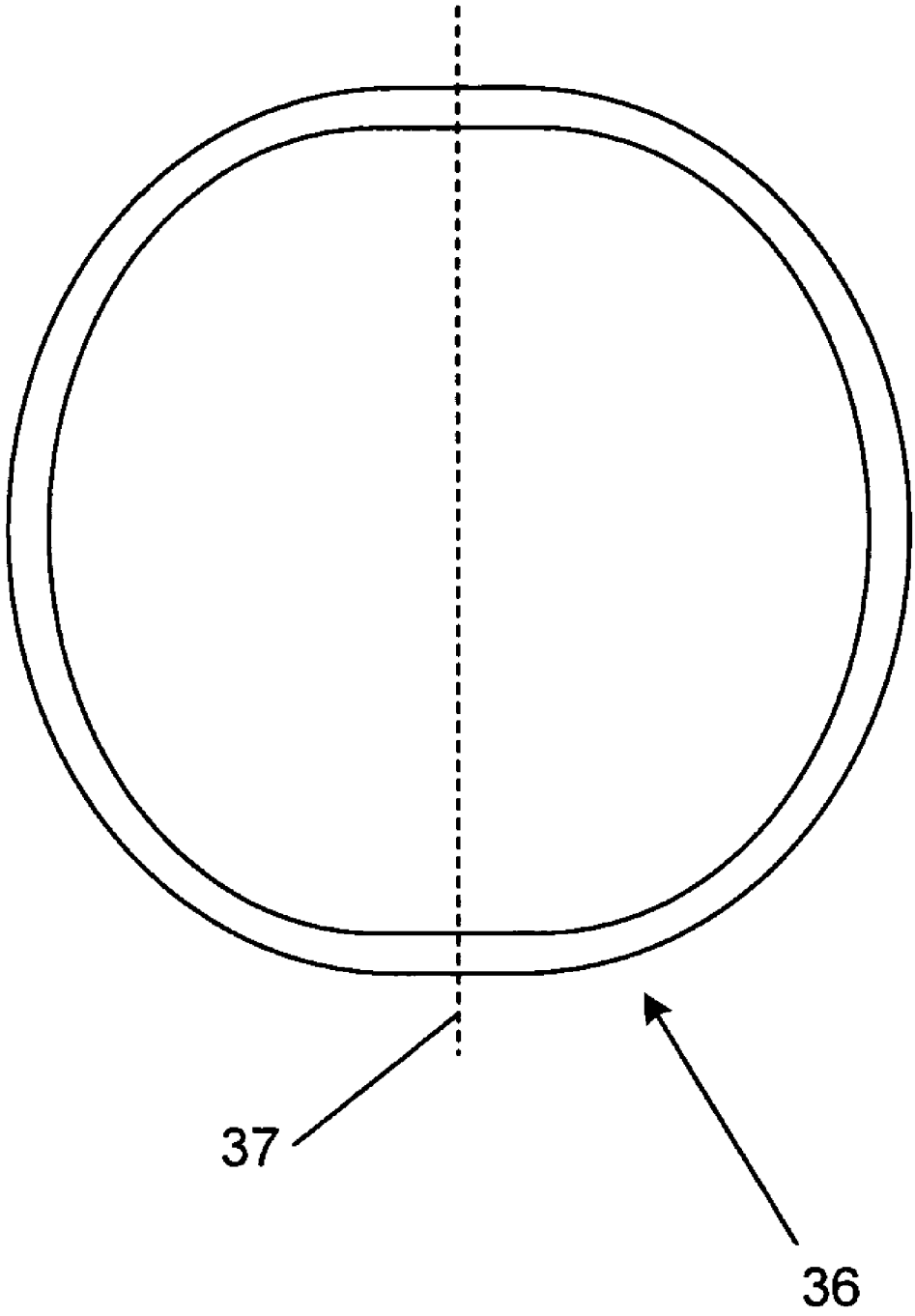
FIG. 33 depicts a cross-sectional view of a hoop.

After removal from the spool 13, the composite material is in the shape of a hoop 36, as is illustrated in FIG. 33. As is further shown in FIG. 33, the hoop 36 is provided with a hoop axis 37. FIG. 33 illustrates, the hoop 36 is symmetric about the hoop axis 37. By cutting the hoop 36 along the hoop axis 37, two identical bodies may be produced. Thus, the present invention is more efficiently and economically manufactured with less scrap and greater through put.

Figure 15:
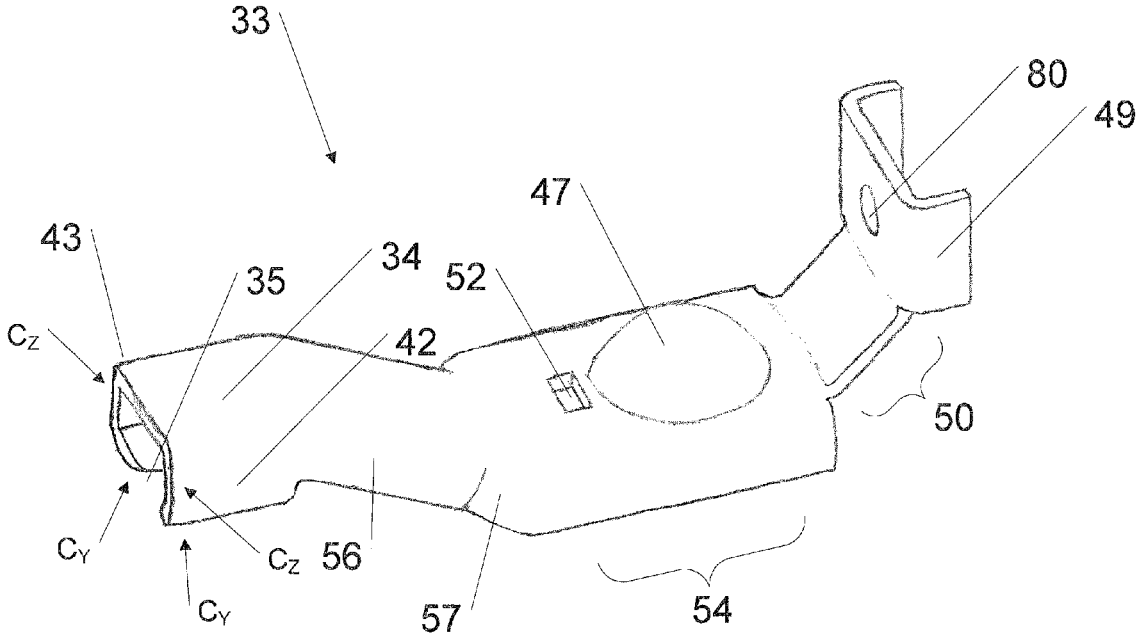
FIG. 15 depicts a perspective view of an embodiment of a base.

After the body 10 is manufactured, it is provided with a plurality of connectors. Referring now to FIG. 15, a base 32 for a guiding connector 33 is shown. In the presently preferred embodiment, the guiding connector 33 is fabricated from a 1010 grade of sheet metal in a multi-station stamping press. As illustrated, the base 32 is provided with a crimping portion 34. The crimping portion 34 is shaped to slip over an end 11, 12 of the body 10. After the crimping portion 34 of the base 32 is slipped over the end 11 of the body 10, the crimping portion 34 of the base 32 is crimped. Referring again to FIG. 15, the base 32 is provided with a slot 35 where, in the preferred embodiment, the crimping force, designated $C_y$, is applied. However, in an alternative embodiment, the crimping force can be applied from the sides 42, 43; in such a case, the side crimping force designated $C_z$ in FIG. 15, in conjunction with force $C_y$, provides the joint with a more secure attachment.

Figure 17:
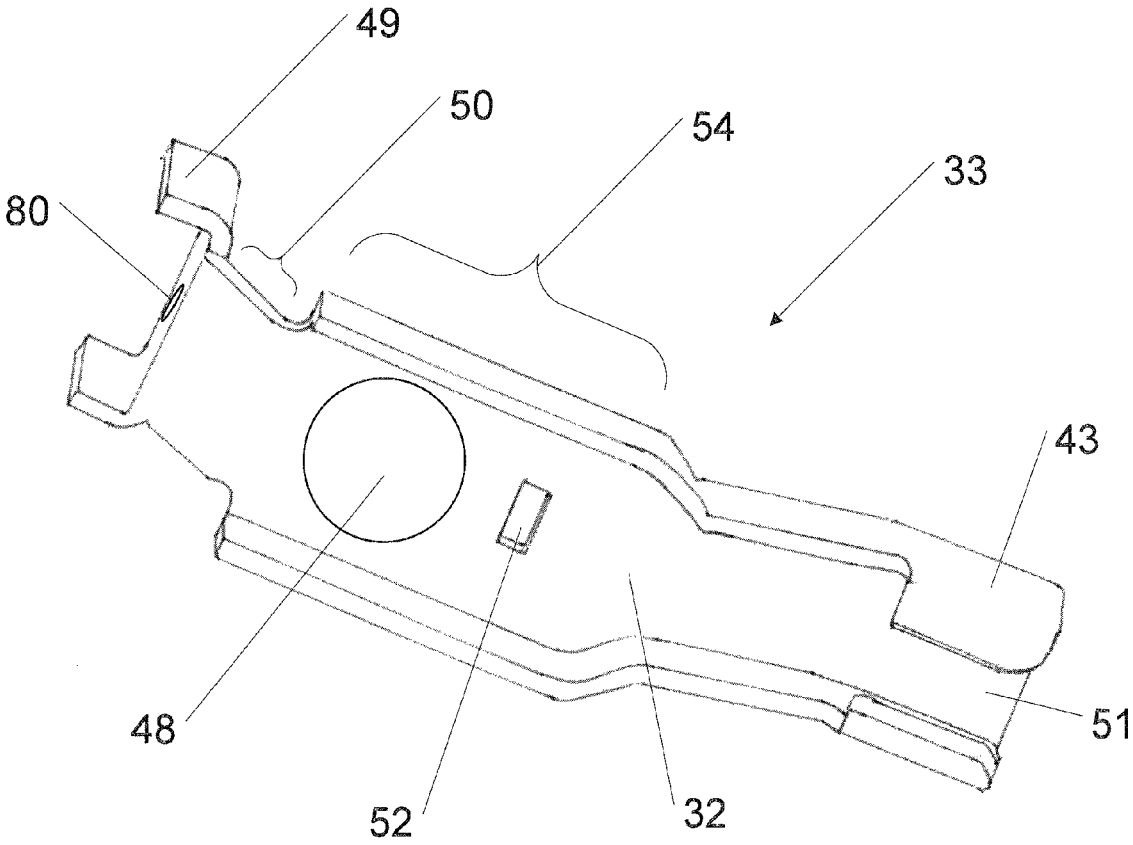
FIG. 17 depicts a perspective view of an embodiment of a base.

As FIG. 15 also illustrates, the base is provided with a dome 47, which corresponds to a recess 48 (which is shown in FIG. 17). The dome 47, (and hence the recess 48) is shaped to hold a fuse (not shown). The base 32 is also provided with an extension 50 and an out-of-round portion 49. The extension 50 is dimensioned to position the out-of-round portion 49 to accept a conductor. The out-of-round portion 49 is shaped to accommodate a conductor and a nut (not shown), and prevent the nut from backing off. The out-of-round portion 49 of the base 32 is also provided with a round hole 80 for a male threaded fastener (not shown). The nut and male threaded fastener secure the conductor to the guiding connector 33 (as will be described in greater detail hereinafter, to a conducting strip 51). Located adjacent to the dome is a hole 52 that is shaped to cooperate with a conducting strip 51. In the presently preferred embodiment, the hole 52 is rectangular in shape and dimensioned to accommodate a hook 53 located on the conducting strip 51.

Figure 34:
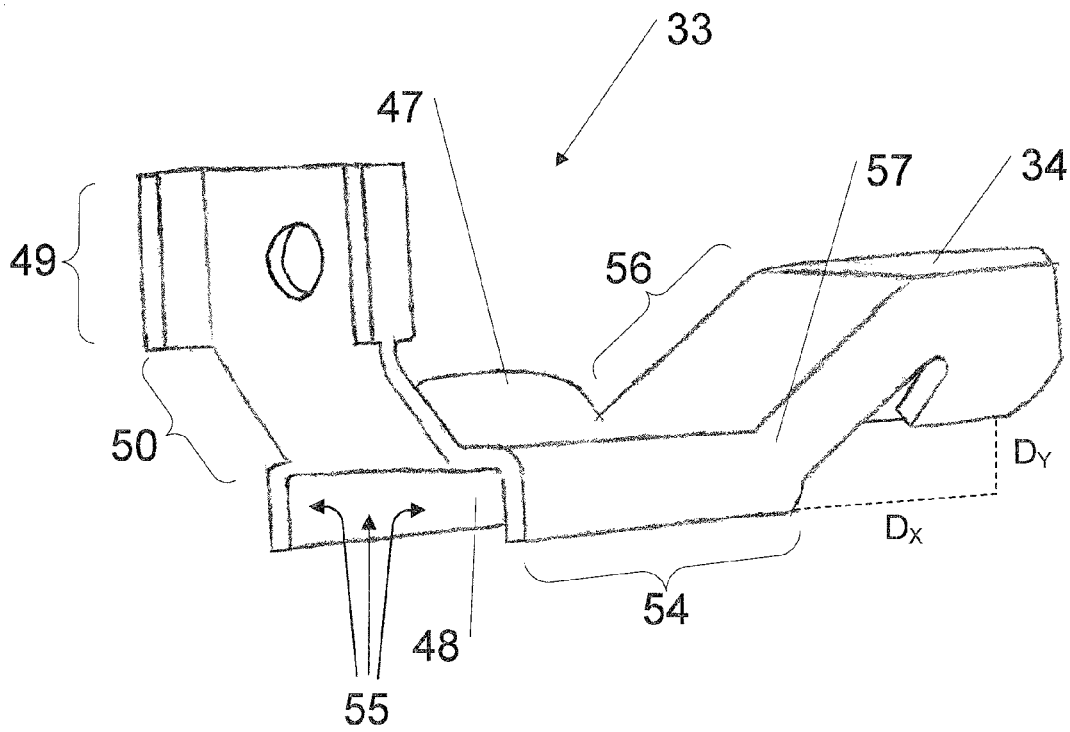
FIG. 34 depicts a perspective view of an embodiment of the base.

As FIG. 34 also illustrates, the base 32 is provided with a fuse accepting portion 54. The fuse accepting portion 54 is shaped to form a guide 55 dimensioned to allow a fuse (not shown) to slide in and seat within the recess 48. The guiding connector 33 is also provided with a positioning arm 56 that is dimensioned to position the dome 47 and recess 48 (and hence the conducting strip 51 as will be apparent below) so that a fuse (not shown) can be inserted. As is illustrated, the positioning arm 56 extends a distance $D_x$, from the crimping portion 34 (and hence from the end 11 of the body 10) and a distance $D_y$ from the crimping portion 34 (and, again, from the end 11 of the body 10). Those skilled in the art will appreciate that in using the subscript "x" and "y," Applicants intend to invoke a "Cartesian coordinate system;" therefore, following this nomenclature, it is within the scope of the present invention that the positioning arm 56 be oriented to extend in a "z" direction as well.

Figure 14:
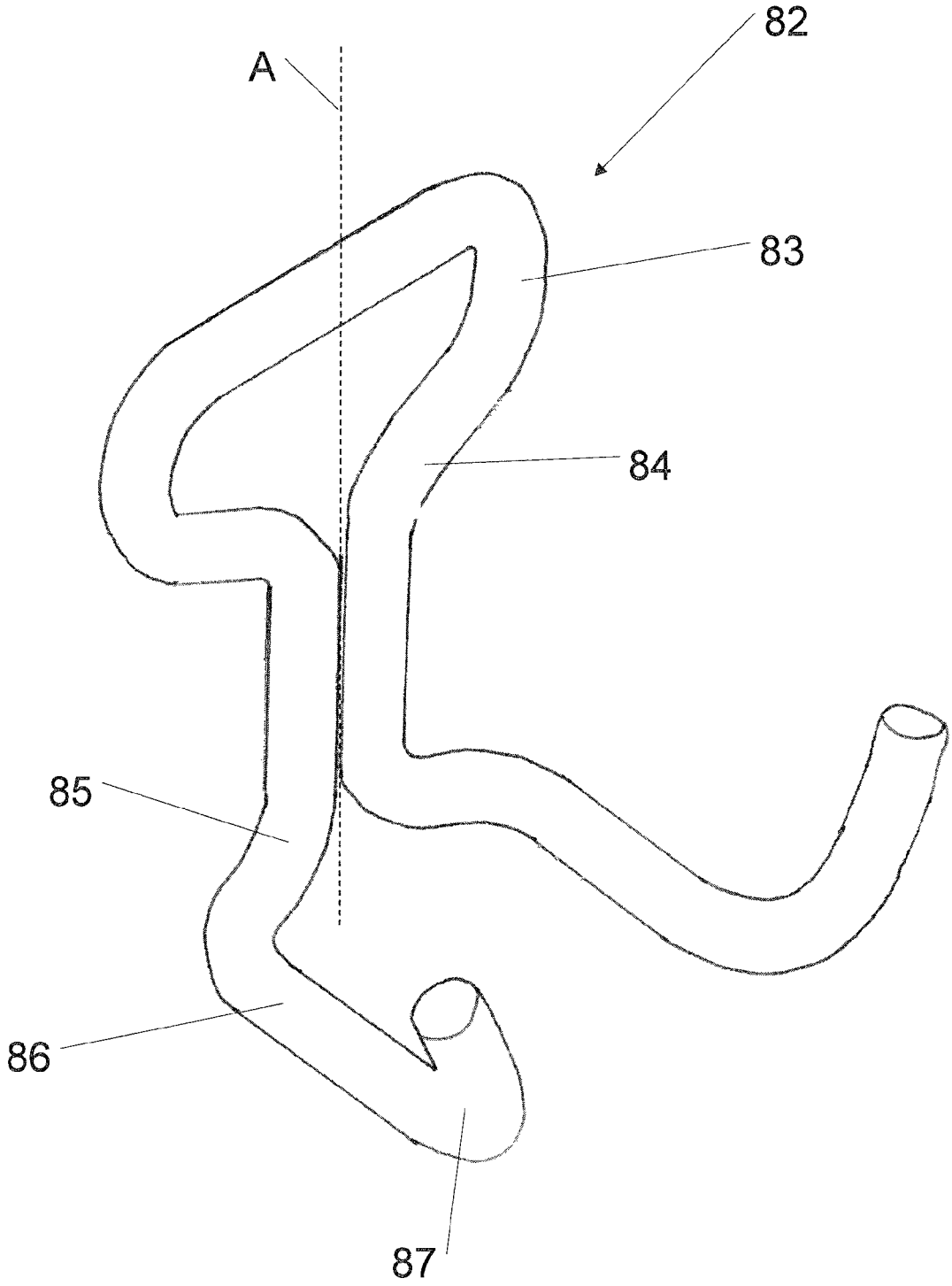
FIG. 14 depicts a perspective view of and embodiment of a tool structure.

The positioning arm 56 extends to a welding portion 57 which is preferably shaped to accept a plurality of hooking arms, 58, 59 (which are shown in FIG. 14 and described in greater detail hereinafter). After being placed on the welding portion 57 of the base 32, the hooking arms 58, 59 are welded to the guiding connector 33.

Figure 11:
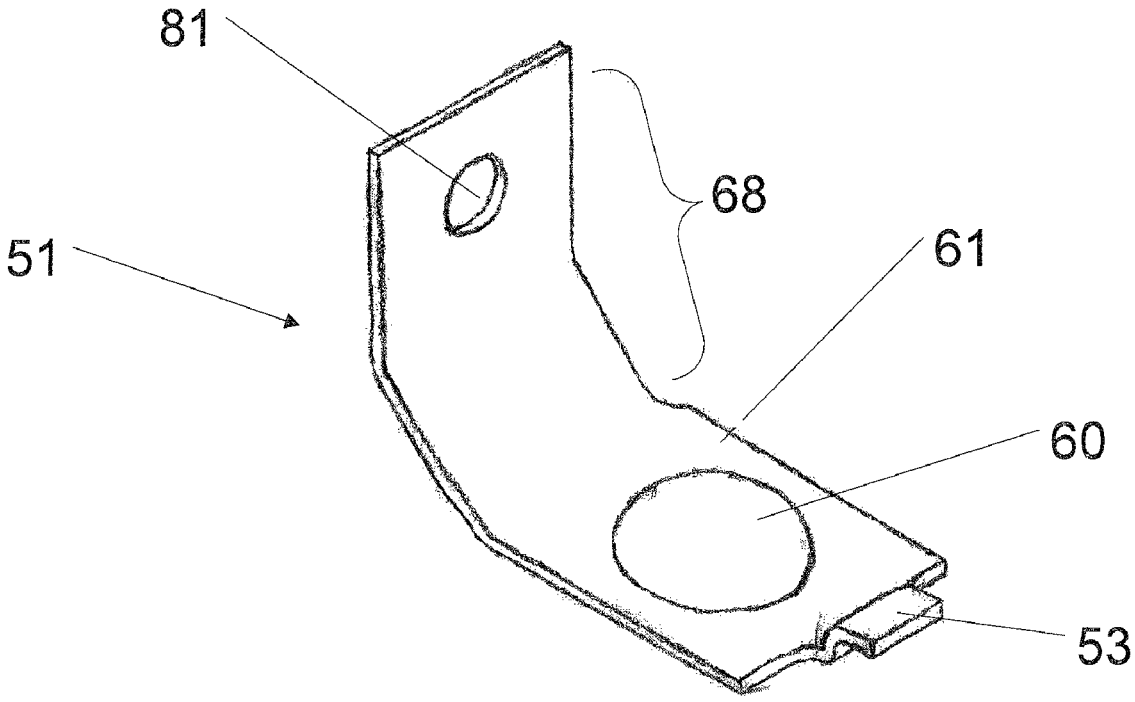
FIG. 11 depicts a perspective view of an embodiment of a conducting strip.
Figure 12:
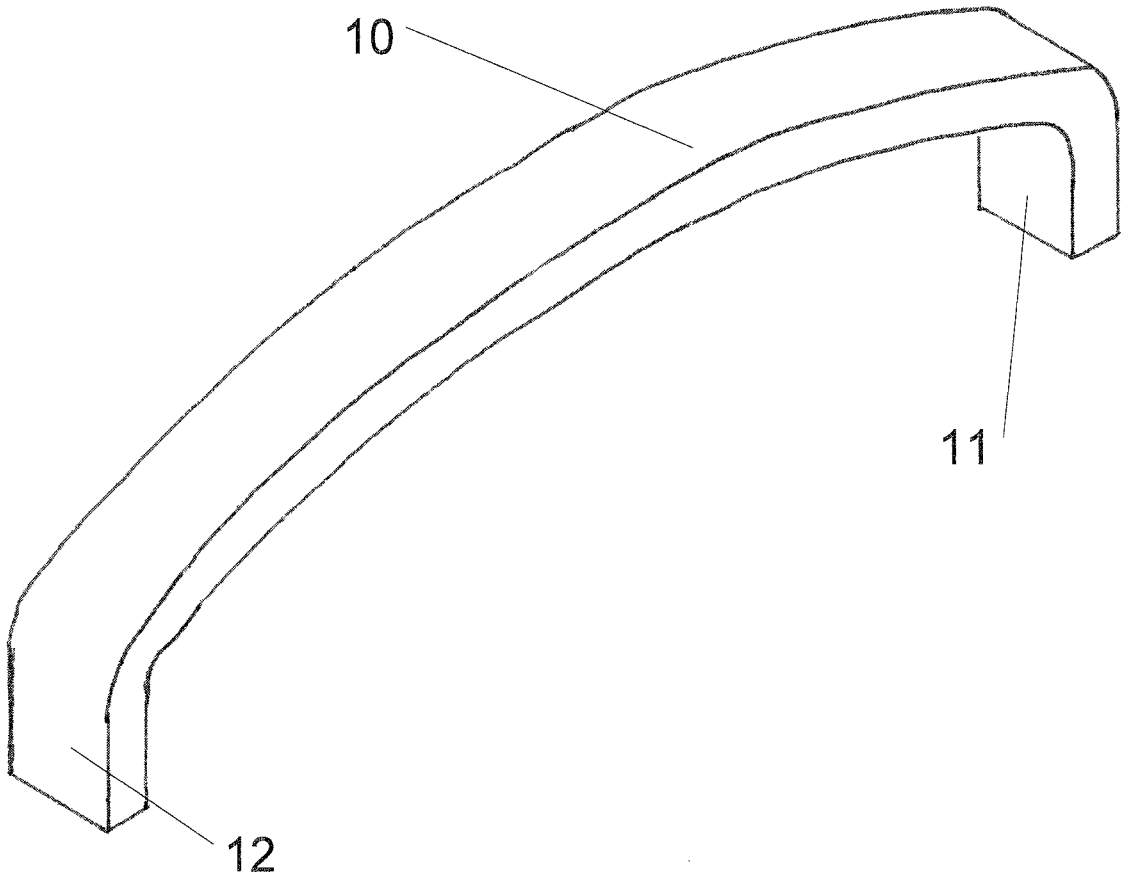
FIG. 12 depicts a perspective view of an embodiment of the body.
Figure 16:
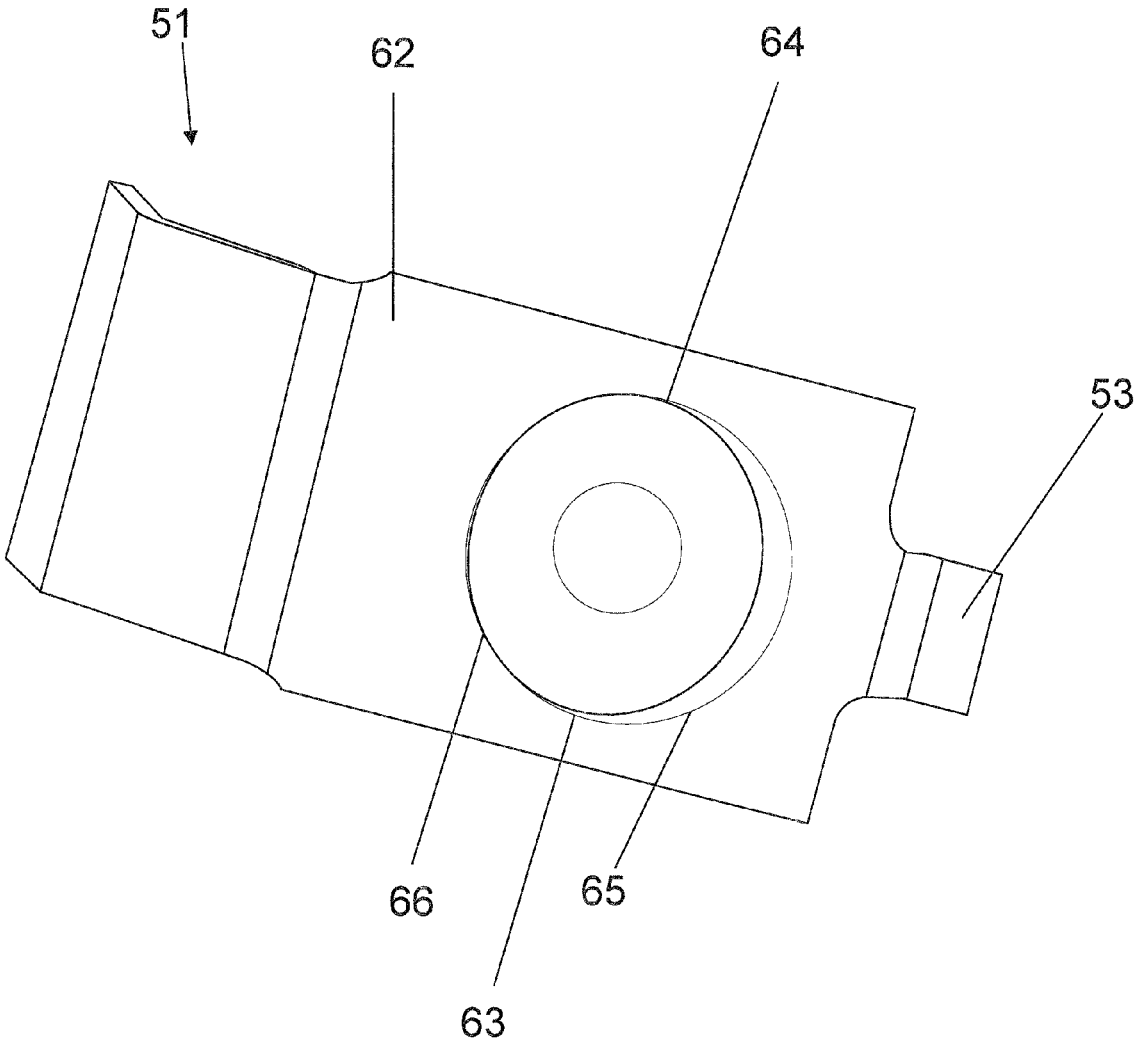
FIG. 16 depicts a perspective view of an embodiment of a conducting strip.
Figure 36:
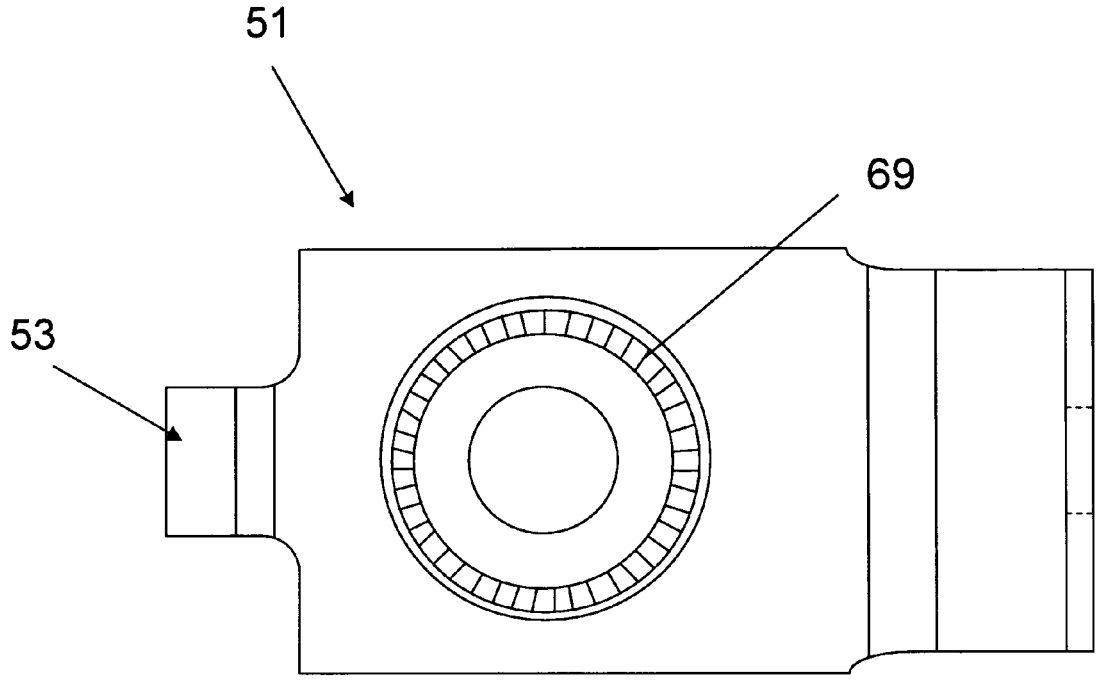
FIG. 36 depicts a bottom-up view of an embodiment of the conducting strip.

Referring now to FIG. 11, the conducting strip 51 is shown in greater detail. The conducting strip 51 is fabricated from a conducting metal, preferably a copper alloy such as brass; however, pure copper is also suitable. The various features of the conducting strip 51 were stamped into the metal via a stamping process. As illustrated therein, the conducting strip 51 is provided with a domed surface 60 that extends from a first strip side 61. The domed surface 60 is shaped to cooperate with the recess 48 of the base 32. As those skilled in the art will appreciate, the conducting strip 51 is provided with a second strip side 62 (the flip side of the first strip side 61). Located within the second strip side 62 is a contact surface 63; as FIG. 16 illustrates, the contact surface 63 is shaped according to the end of a fuse (not shown); because fuses are generally cylindrical in shape (and hence circular in cross-section), the contact surface 63 is circular in shape and provided with a plurality of contacts 64, 65, 66. The contact surface 63 is located on the flip-side of the domed surface 60 (which extends from the first strip side 61 of the conducting strip 51). Therefore, it can be said the contact surface 63 extends into the second strip side 62 of the conducting strip 61, while the contacts 64, 65, 66 extend from the contact surface 63 (and hence, from the second strip side 62). The contacts 64, 65, 66 are thus in the form of raised bumps that extend from the contact surface 63 on the second strip side 62 of the conducting strip 51. It is preferred that the conducting strip 51 be provided with three contacts 64, 65, 66, as is shown in FIG. 16; however, in alternative embodiments, the conducting strip 51 is provided with four, five, six contacts (or in the shape of a contact ring, as shown in FIG. 36, which would theoretically represent an infinite number of contacts).

As FIG. 11 illustrates, the conducting strip 51 is provided with a conducting extension 68. The conducting extension 68 electrically connects the domed surface 60 (and hence the fuse) to a conductor (not shown). The dimensions of the conducting extension 68 enable the conducting strip 51 to lay along the extension 50 of the base 32 and within the out-of-round portion 49 of the guiding connector 33. A hole 81 is provided in the conducting strip 51 that is dimensioned to cooperate with the hole 80 formed within the out-of-round portion 49 of the guiding connector 33.

In use, the hook 53 of the conducting strip 51 is inserted into the hole 52 within the fuse accepting portion 54 of the guiding connector 33. The conducing strip 51 is oriented so that the first strip side 61 fits within the fuse accepting portion 54, and the domed surface 60 fits within the recess 48 of the guiding connector 33. The conducting extension 68 lays within the out-of-round portion 49 of the guiding connector 33 and is fastened thereto via the holes 80, 81, a male threaded fastener, and a nut.

Figure 6:
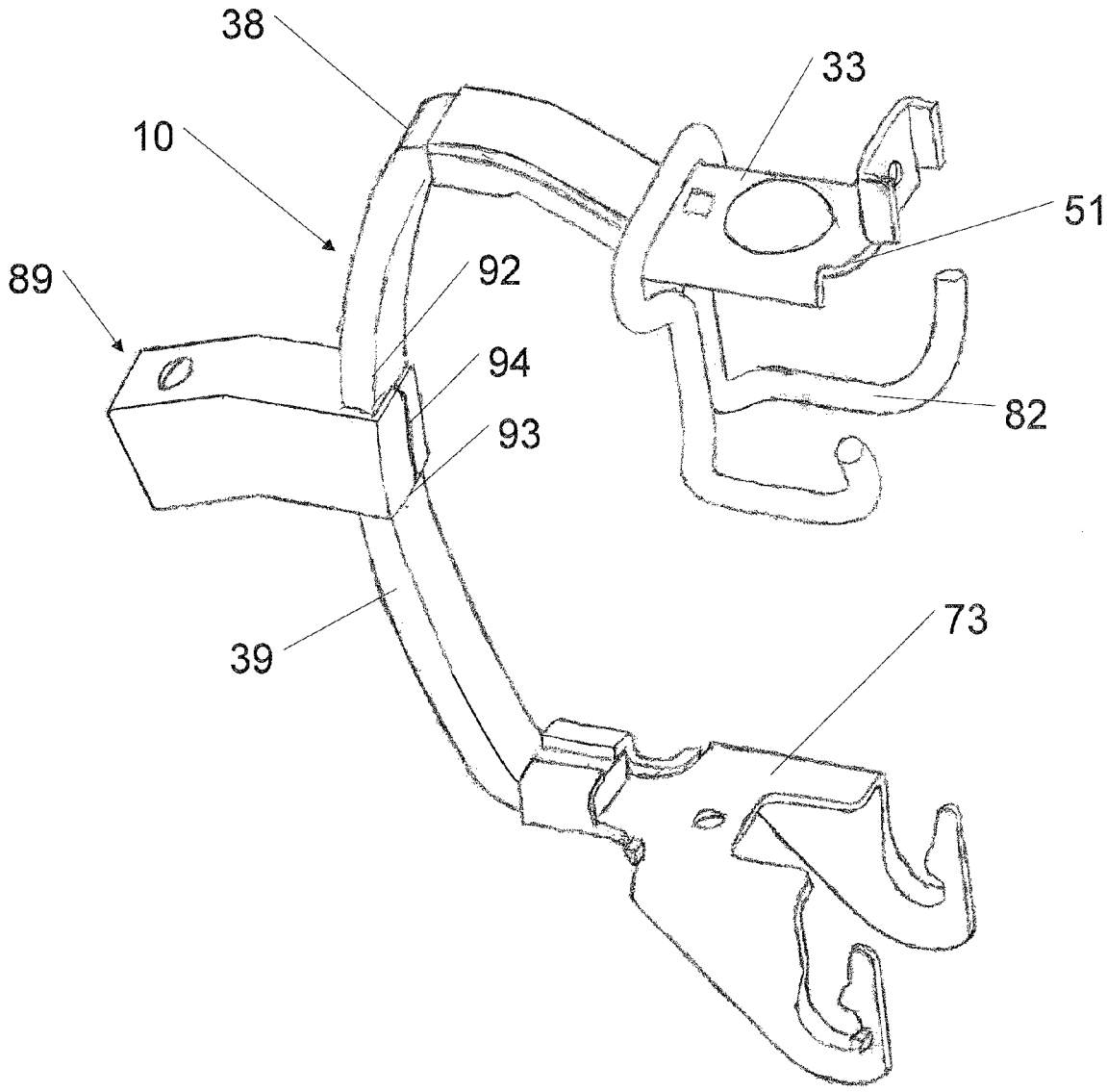
FIG. 6 depicts a perspective view of an embodiment of the insulator.
Figure 7:
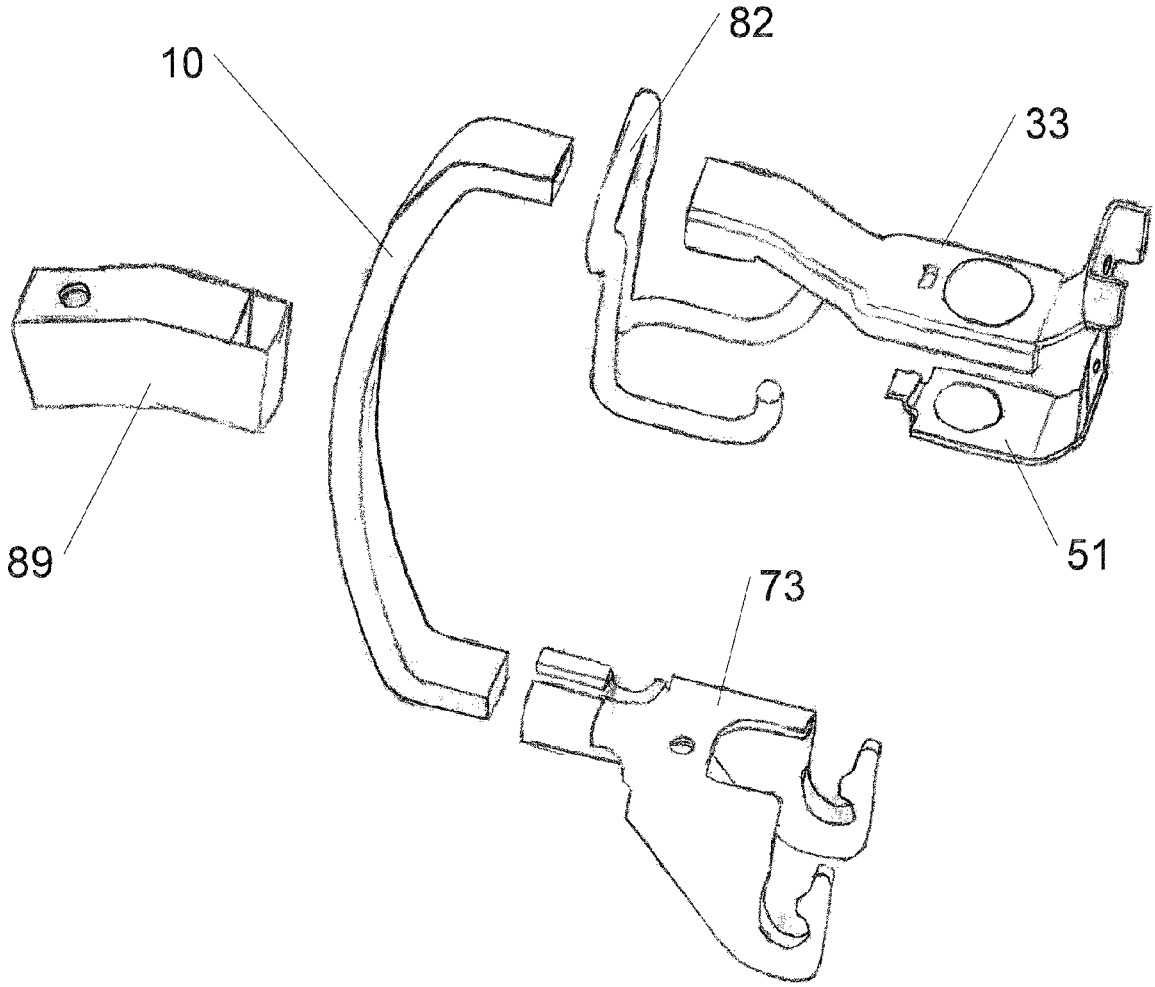
FIG. 7 depicts an exploded perspective view of an embodiment of the insulator.
Figure 13:
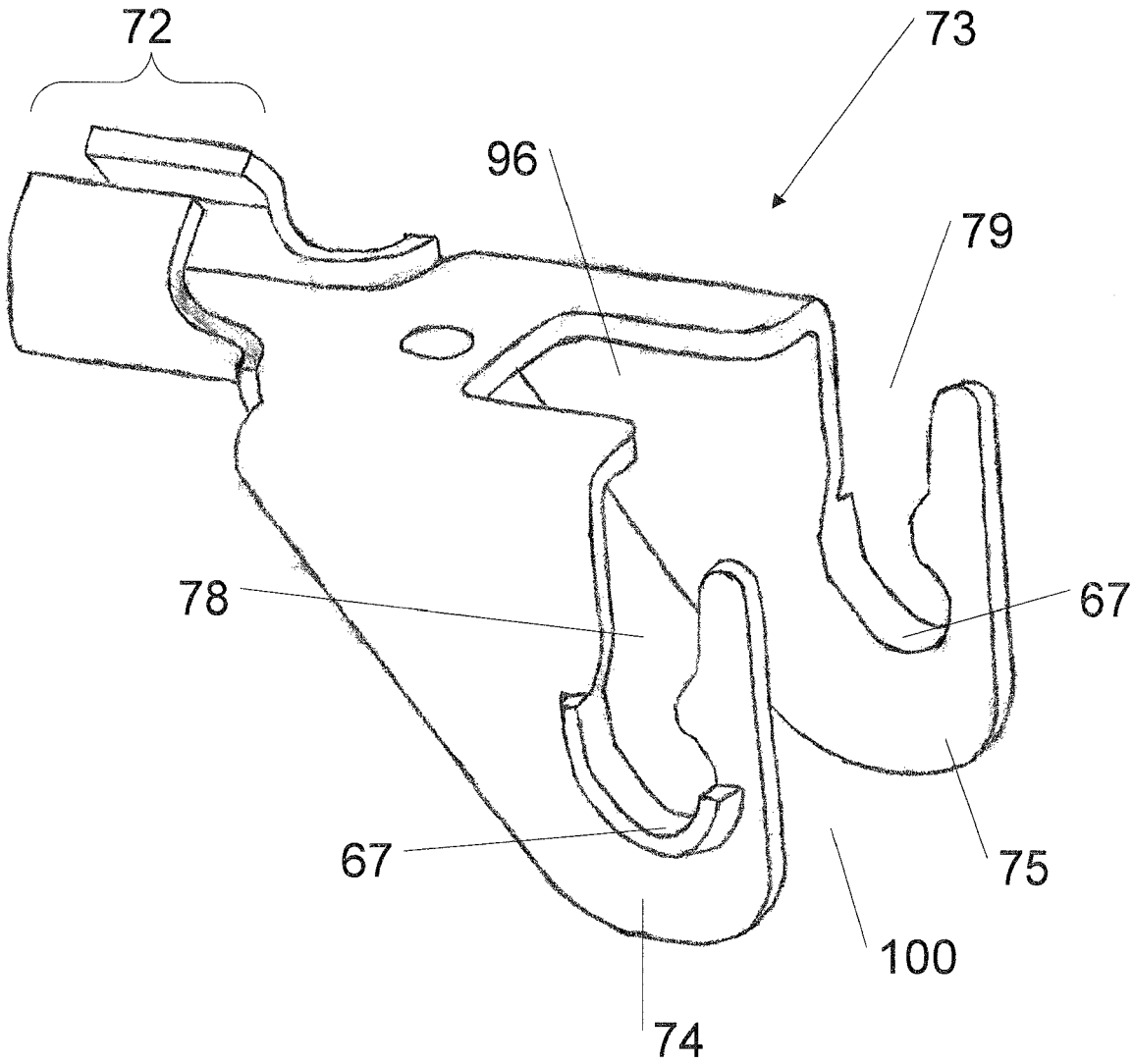
FIG. 13 depicts a perspective view of an embodiment of a pivot connector.

Turning now to FIG. 13, a pivot connector 73 is shown. Preferably, the pivot connector is fabricated from a 1010 grade of steel sheet metal and stamped into shape via a multi-station stamping press. The pivot connector 73 is provided with a plurality of trunnion holders 74, 75. The trunnion holders 74, 75 are shaped to accept a trunnion 76 on a fuse end 77 and allow the trunnion 76 pivot. As FIG. 13 illustrates the trunnion holders 74, 75 are provided with slots 78, 79 with a pivoting surface 67 that is cylindrical in shape. Thus, when the trunnion 76 with placed on the pivoting surface 67, the fuse assembly 70 can rotate, preferably so that the end 71 of the fuse assembly 70 rotates away from the body 10. In the embodiment depicted in FIG. 13, the pivot connector 73 is provided with a connector slot 96 that is shaped to accept and cooperate with a connector. However, in the preferred embodiment, the pivot connector 73 is provided with a crimping portion 72, much like the crimping portion 34 on the guiding connector 33. As both FIGS. 6 and 13 show, the pivot connector is provided with a passage 100 that is shaped to allow at least a portion of the fuse assembly 70 to pass through.

Figure 40:
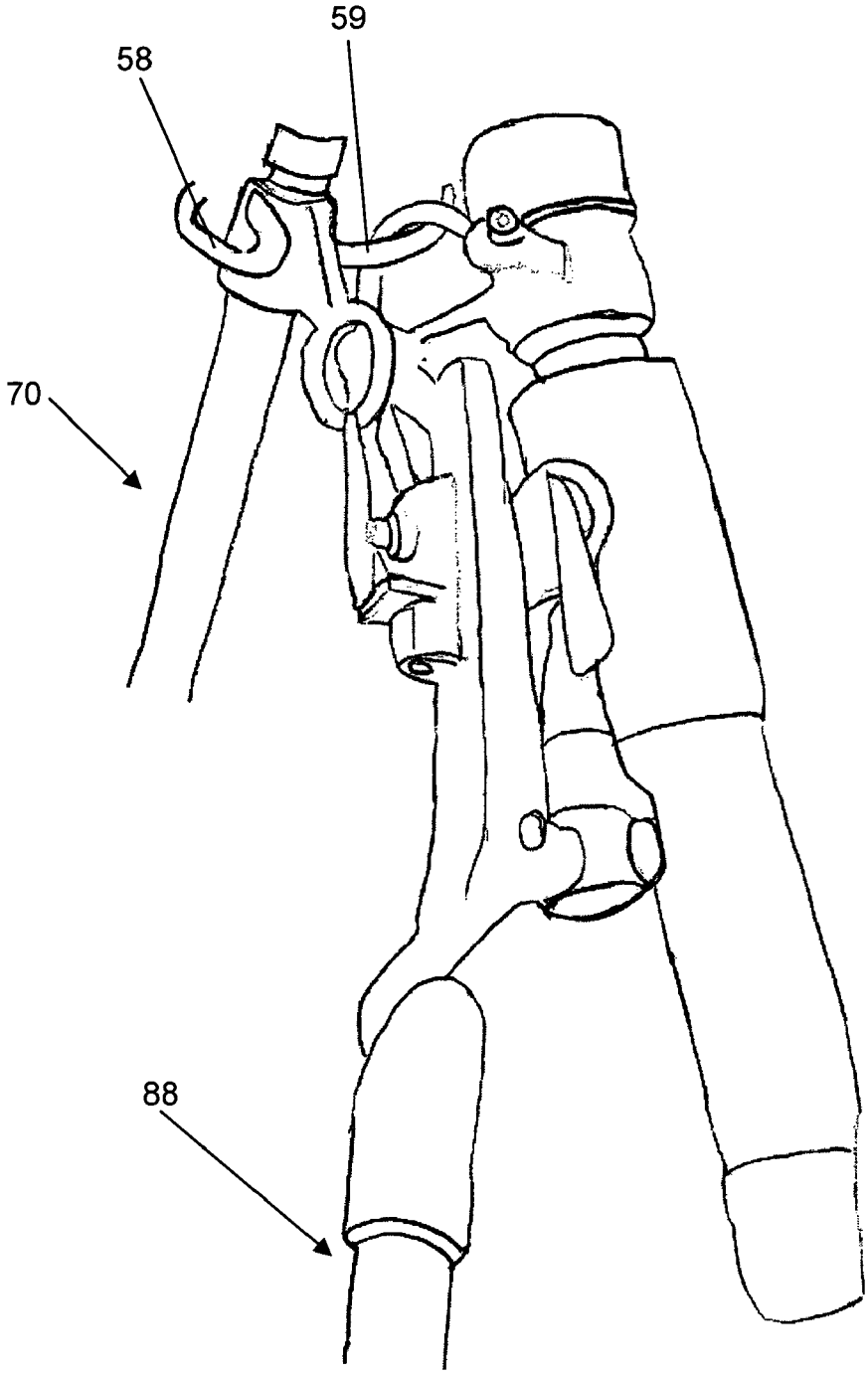
FIG. 40 depicts a perspective view of the installation tool cooperating with the hooking arms and the fuse assembly.

Referring now to FIG. 14, a tool structure 82 is shown. As illustrated therein, the tool structure 82 is fabricated from a single piece of wire or rod and bent into shape. While the embodiment shown in FIG. 14 is a single piece of wire, it is preferred that the tool structure 82 be fabricated as two identical pieces along the line designated "A" in FIG. 14. As noted above, and as illustrated, the tool structure 82 is provided with a pair of hooking arms 58, 59. The tool structure 82 is bent at a plurality of bend locations 83, 84, 85, 86, 87. By looking at FIG. 14, those skilled in the art will understand where the tool structure 82 is bent. The tool structure 82 is bent so that the hooking arms 58, 59 can engage an installation tool 88, as shown in FIG. 40.

Figure 37:
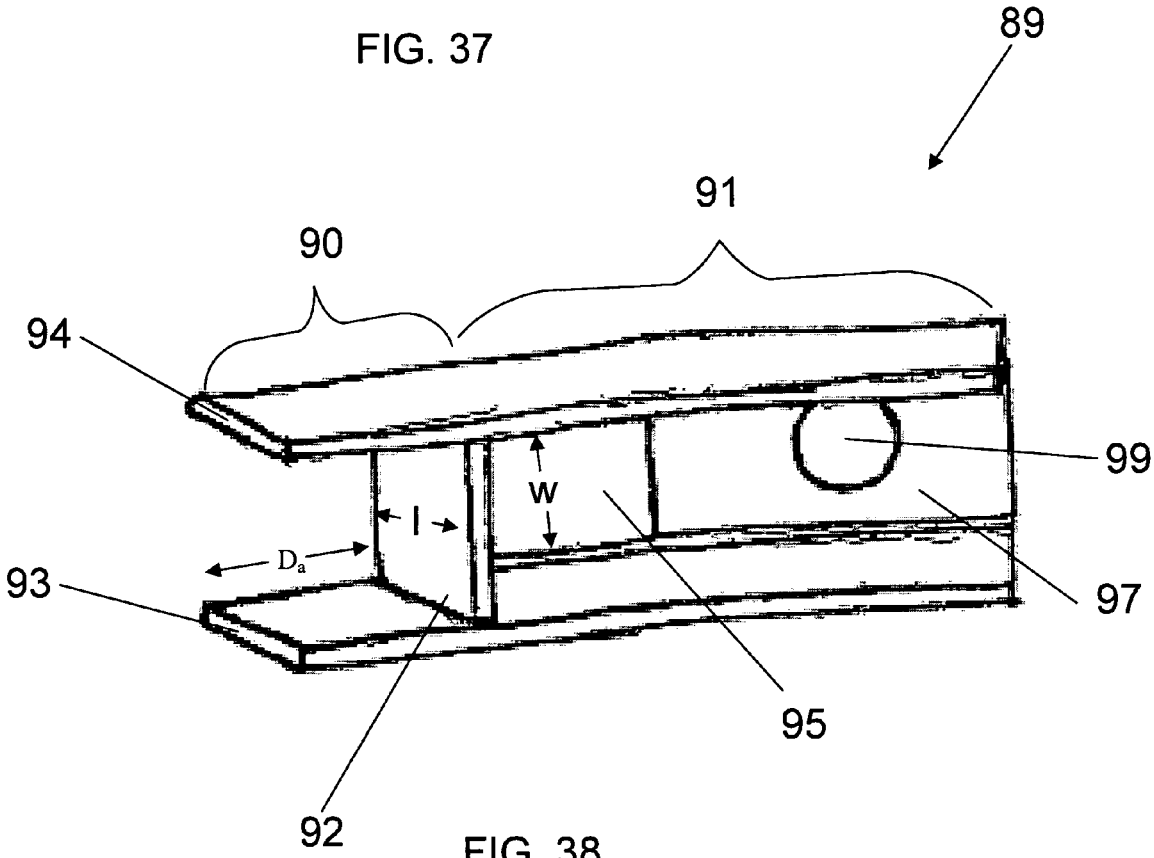
FIG. 37 depicts a perspective view of an embodiment of a mounting connector.
Figure 38:
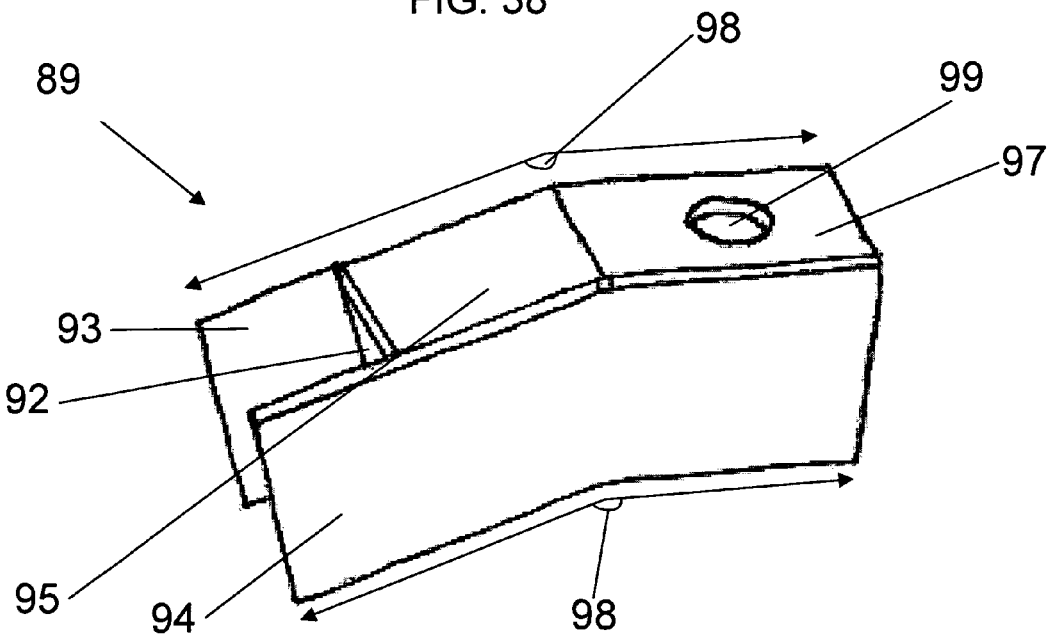
FIG. 38 depicts a perspective view of an embodiment of a mounting connector.
Figure 39:
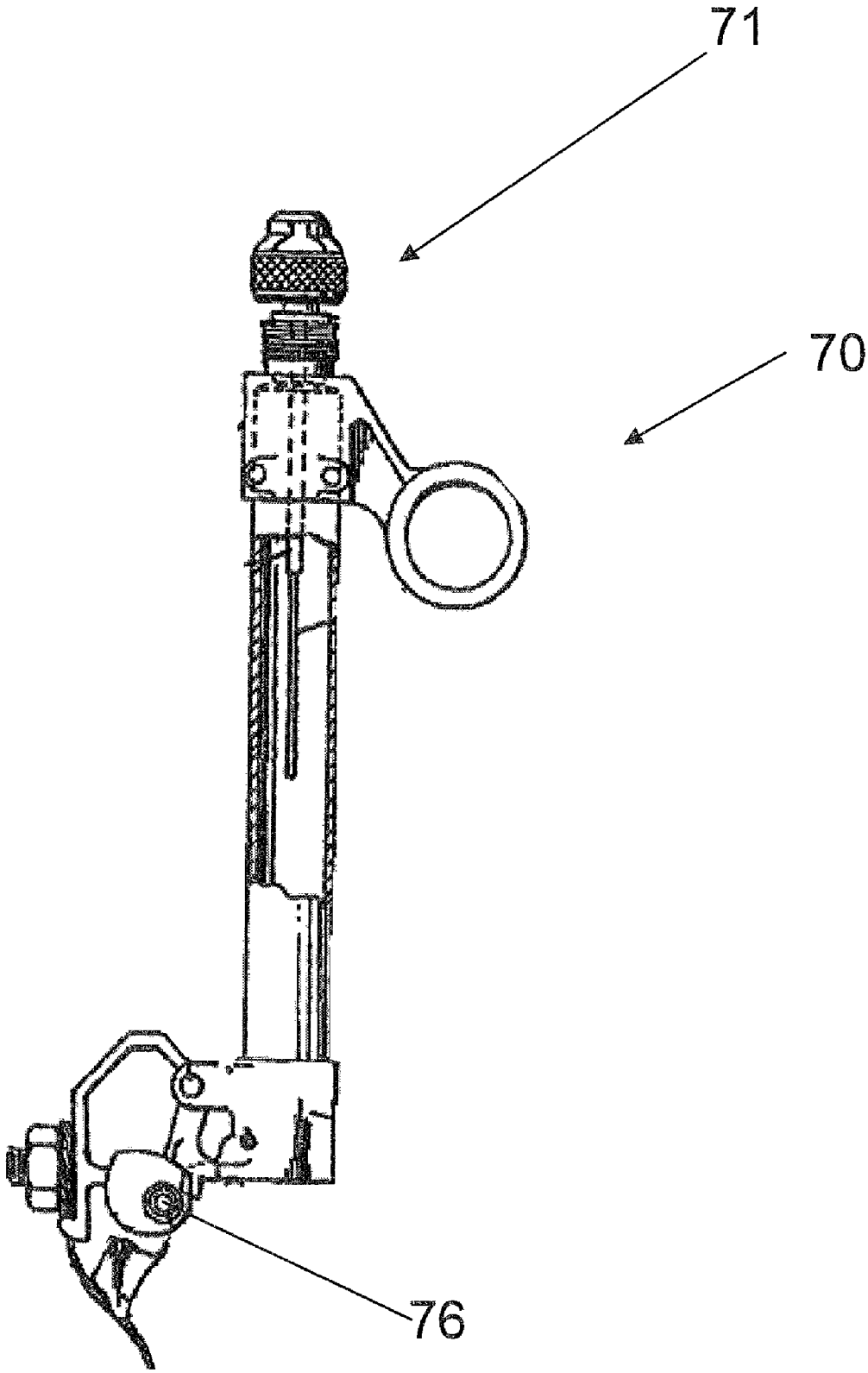
FIG. 39 depicts a cut away view of an embodiment of a fuse assembly.

The body 10 is secured to a utility structure (such as a pole or cross arm) via a mounting connector 89, as is shown in FIG. 37. The mounting connector 89 constituting the presently preferred embodiment is fabricated from a 1010 grade of steel in the form of sheet metal. The 1010 sheet metal is stamped into shape via a multi-station stamping press. As FIG. 37 illustrates, the sheet metal has been bent to provide a crimping portion 90 and an extending portion 91. The crimping portion 90 is provided with a supporting surface 92 and a pair of crimping arms 93, 94. The supporting surface 92 is bent to be orthogonal to the extending sheet 95 so that, after the mounting connector 89 is crimped to the body 10, rubber (or a liquid elastomer such as an epoxy resin) can flow around the crimped joint. In the presently preferred embodiment, the mounting connector 89 is provided with an extending portion 91. Included within the extending portion 91 of the mounting connector 89 is an extending sheet 95 and a securing sheet 97. In the presently preferred embodiment, the sheet metal is bent so that the extending sheet 95 and the securing sheet 97 are oriented with respect to one another to form an angle 98, as shown in FIG. 38. However, in an alternative embodiment, the supporting surface 92 is bent past 90° so that the extending sheet 95 and the securing sheet 97 are co-planar. As FIG. 38 illustrates, the securing sheet 97 is provided with a hole 99 for a fastener that secures the mounting connector 89 (and hence the body 10 after the mounting connector 89 has been crimped thereon) to a utility pole or cross-arm.

The mounting connector 89 is firmly secured to the body 10 through the crimping arms 93, 94, and the supporting surface 92. The crimping arms 93, 94 are crimped around the body 10, as illustrated in FIG. 6. The supporting surface 92 is dimensioned to prevent relative motion between the mounting connector 89 and the body 10. The supporting surface 92 is provided with a length designated "l" in FIG. 37. The length l of the supporting surface 92 is dimensioned so that the securing sheet 97 dose not move towards either of the ends 11, 12, of the body 10 after the mounting connector 89 has been crimped onto the body 10. Similarly, the supporting surface 92 is provided with a width designated "w" in FIG. 37. The width is dimensioned so that the securing sheet 97 does not move towards either of the side walls 39, 40 of the body 10, after the mounting connector 89 has been crimped to the body 10. In the presently preferred embodiment, the width w of the supporting surface 92 is equal to the corresponding width of the mounting side 38 of the body 10.

Referring now to FIG. 6, the mounting connector 89 is shown crimped to the body 10. As illustrated therein, the supporting surface 92 contacts the mounting side 38 of the body 10 and the crimping arms 93, 94 are crimped around the side walls 39, 40 to contact and lay across the fuse side 41 of the body 10. The crimping arms 93, 94 are dimensioned according to at least one of the side walls 39, 40 and the contact side of the body 10. In the preferred embodiment, the crimping arms 93, 94 extend from the supporting surface 92 a distance designated "$D_a$" in FIG. 37; because the edges of the crimping arms 93, 94 contact each other or form a small seam after crimping, one skilled in the art will understand that the distance $D_a$ is equal to the width of one of the side walls 39, 40 plus ½ the width of the fuse side 41 of the body 10. In an alternative embodiment, the distance $D_a$ is equal to the width of one of the side walls 39, 40 plus ½ the width w of the supporting surface 92.

Figure 8:
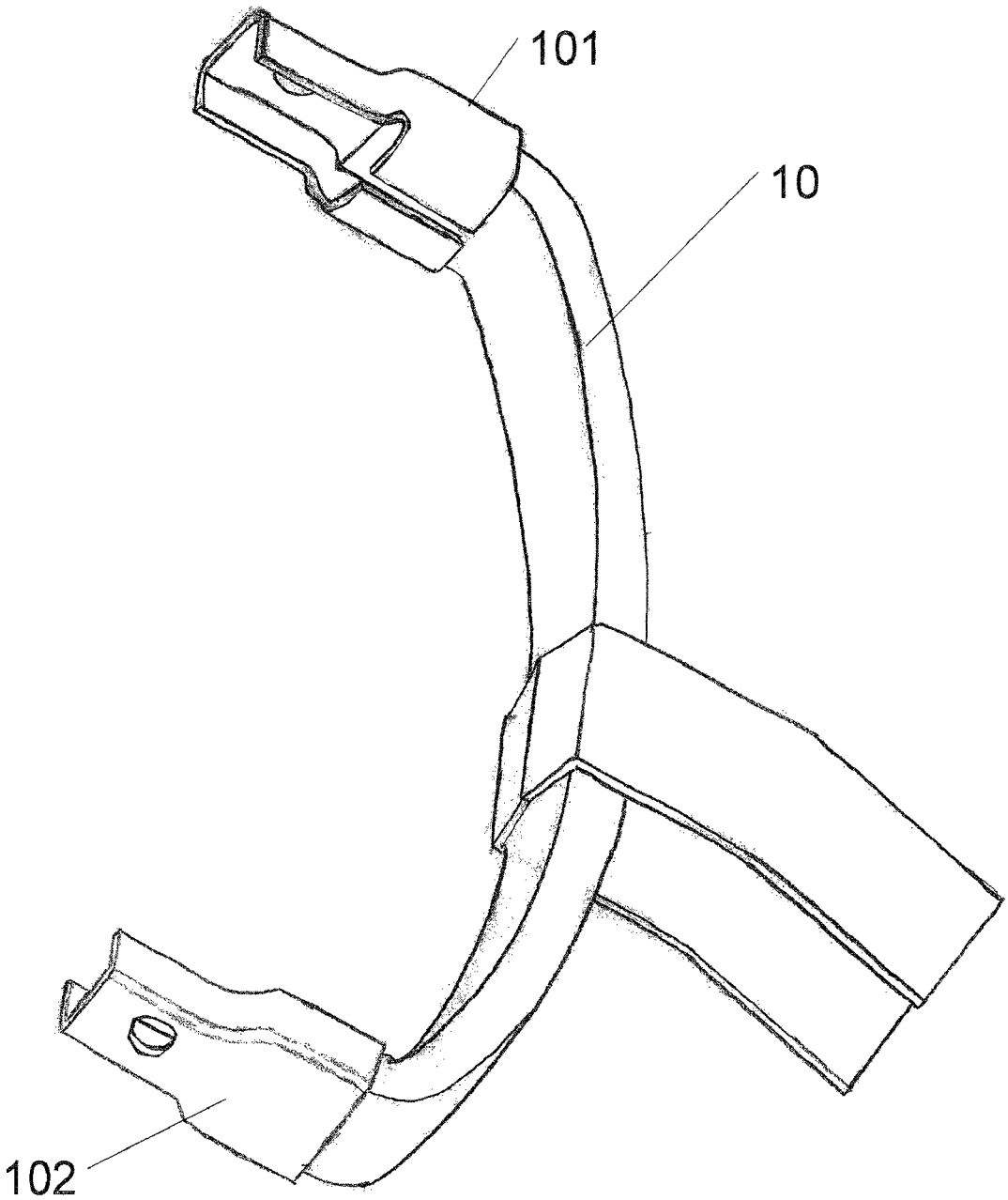
FIG. 8 depicts a perspective view of an embodiment of the insulator.
Figure 9:
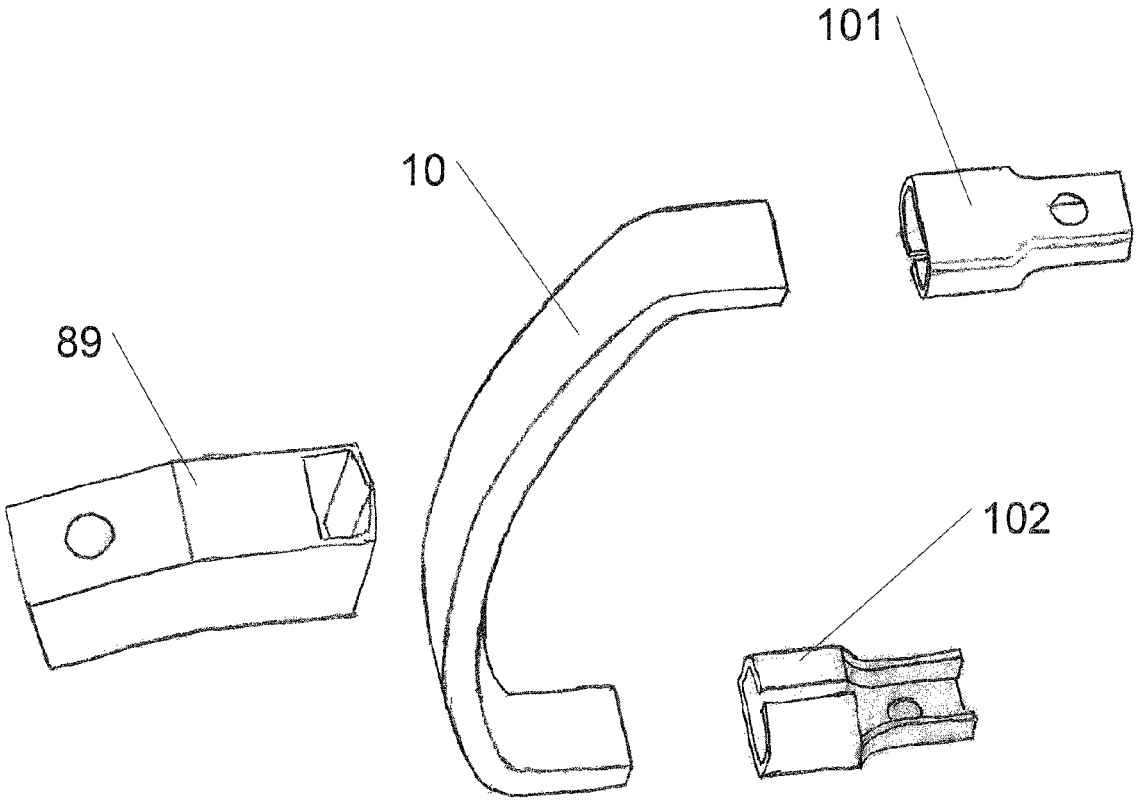
FIG. 9 depicts an exploded perspective view of an embodiment of the insulator.
Figure 10:
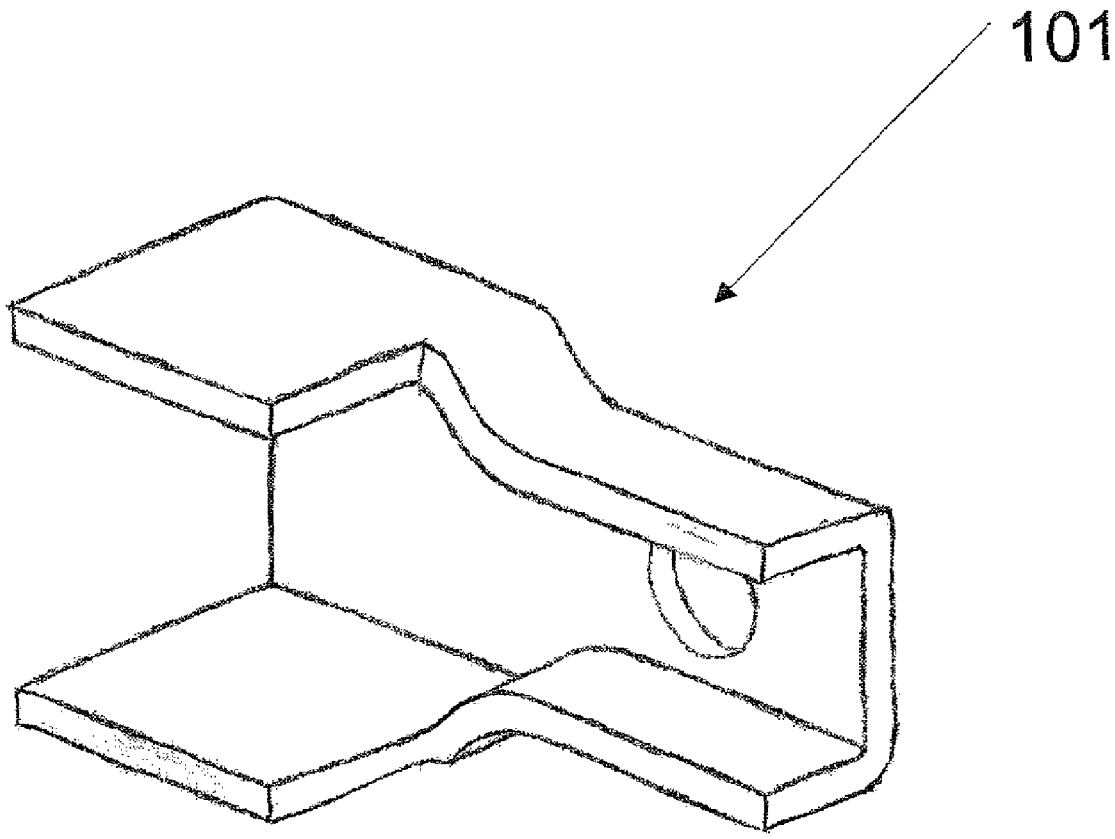
FIG. 10 depicts a perspective view of an embodiment of a universal connector.

While the preferred embodiment is provided with a mounting connector 89, a guiding connector 33, and a pivot connector 89, an alternative embodiment is provided with a mounting connector 89 and two universal connectors 101, 102, as shown in FIG. 8. The universal connectors 101, 102 are fabricated from a 1010 grade of steel in the form of sheet metal. The sheet metal is bent into shape via a multi-station stamping press. FIGS. 9 and 10 illustrate a universal connector 101, 102, fabricated from a 1010 sheet of steel that has been bent into shape. As is the case with all of the connectors illustrated herein, the sheet metal is first cut into a pattern, bent into shape, and then crimped onto the body 10, as shown in FIGS. 6 and 8.

Figure 35:
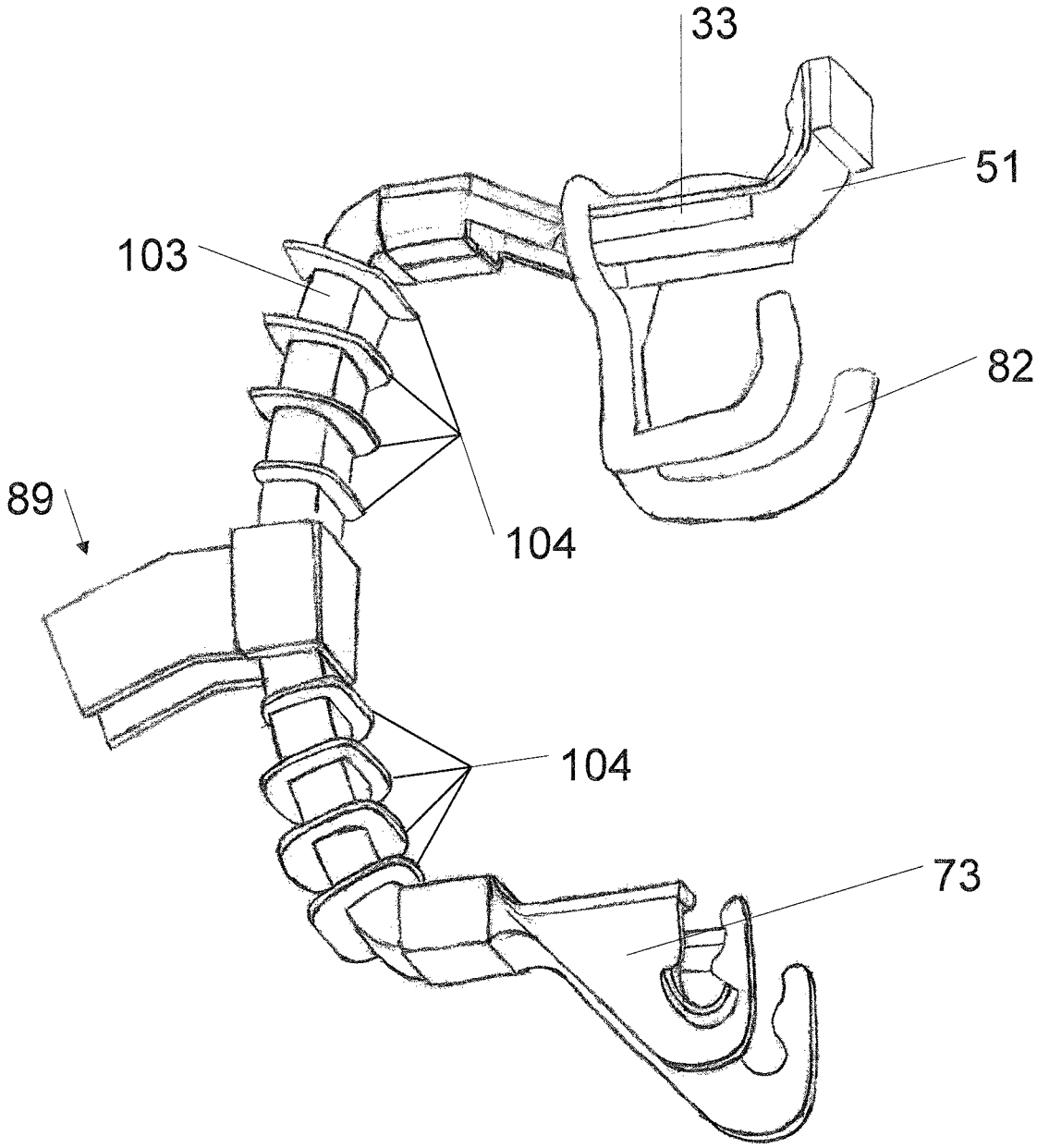
FIG. 35 depicts a perspective view of an embodiment of the insulator.

After the connectors have been crimped onto the body 10, as FIGS. 6 and 8 illustrate, silicone rubber is molded onto the body 10 to form a housing 103. In the preferred embodiment depicted in FIG. 35, the housing 103 is made of silicone rubber. According to another aspect of the present invention, the housing 103 is made of an elastomer. According to yet another aspect of the present invention, the housing 103 is made of rubber. In another aspect of the present invention, the housing 103 is made of EPDM. In yet another aspect of the present invention, the housing 103 is made of room temperature vulcanized rubber ("RTV rubber"). According to yet another aspect of the present invention, the housing 50 is made of a combination of rubber and elastomer materials.

The housing 103 of the preferred embodiment is made through an injection molding process known as insert molding. According to one aspect of the present invention, the housing 103 is made through transfer molding. According to another aspect of the present invention, the housing 103 is made through compression molding. According to yet another aspect of the present invention, the housing 103 is made through extruding and rolling silicon rubber onto the body 10.

Figure 22:
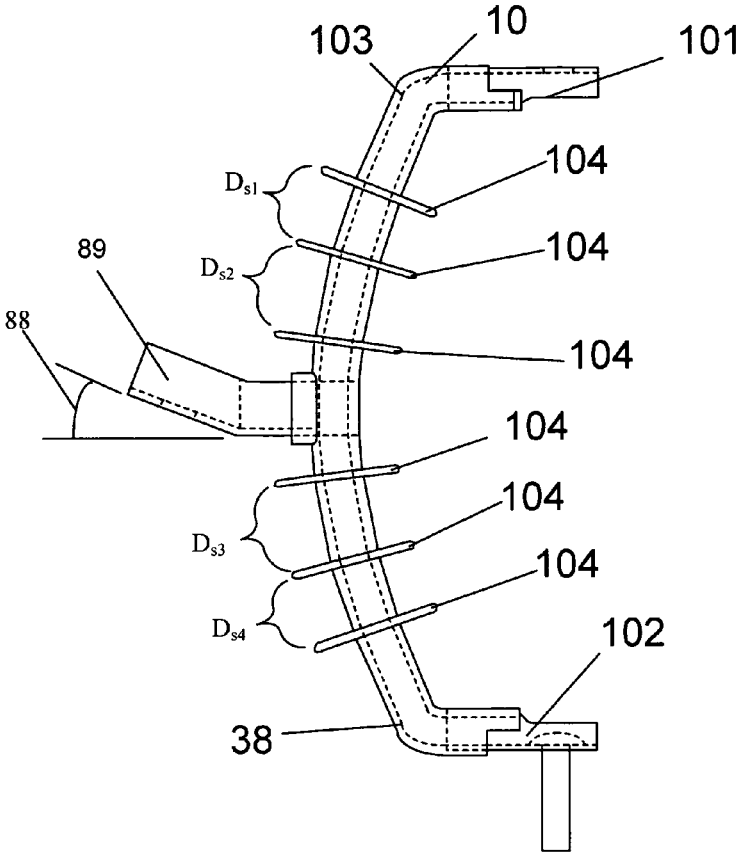
FIG. 22 depicts a side view of an embodiment of the insulator.

As depicted in FIG. 22, the body 10 is situated inside the housing 103. In the presently preferred embodiment, the housing 103 is insert-molded around the body 10. The body 10 of the preferred embodiment is inserted into a two-piece mold, which has been previously shaped with ridges; then, the mold is closed. The ridges are shaped to form sheds 104 onto the body 10. While the housing 103 of the preferred embodiment is made through use of silicone rubber and a two-piece mold, other molds can be used. According to one aspect of the present invention, the mold includes an extrusion nozzle.

Figure 23:
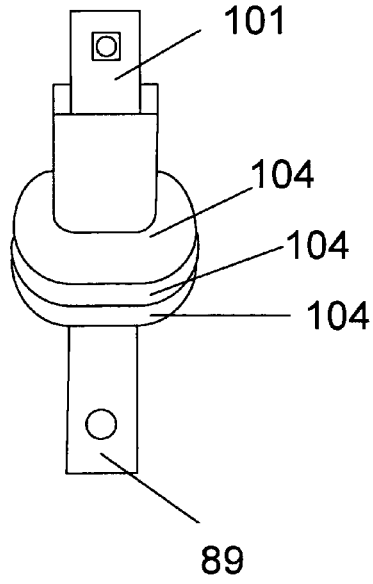
FIG. 23 depicts a top-down view of an embodiment of the insulator.

To make the preferred embodiment, silicone rubber is injected into the mold so that the silicone rubber assumes the form of the housing 103 with sheds 104. In the preferred embodiment of the present invention, the sheds 104 increase the surface distance from one end of the housing 103 to the other. As FIG. 23 illustrates, a body 10 with a curved shape can be advantageously utilized to use less silicone rubber in the housing 103. The curved shape of the body 10 (and hence the housing 103 after it has been molded onto the body 10) increases the surface distance along the mounting side 38 of the body 10. Thus, it is unnecessary for the sheds 104 to extend beyond the mounting side 38 of the body 10. Additionally, as FIG. 22 illustrates, the distances between the sheds 104 (designated $D_{S1}$, $D_{S2}$, $D_{S3}$, $D_{S4}$) can be increased, thereby requiring less rubber in the housing 103.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A fuse cutout assembly, comprising:

a) a body, that has been filament wound, provided with a first end, a second end, a fuse side, and a mounting side;

b) a mounting connector including a crimping portion and an extending portion, the crimping portion of the mounting connector includes a first crimping arm and a second crimping arm that locate the mounting connector on the body between the first end and the second end;

c) a guiding connector including a crimping portion, a fuse accepting portion, a dome, a recess, and an out-of-round portion, wherein the guiding connector is crimped to the first end of the body;

d) a conducting strip including a domed surface, a conducting extension, and a contact, wherein the domed surface cooperates with the recess and the conducting extension is located adjacent to the out-of-round portion of the guiding connector;

e) a tool structure provided with a first hooking arm and a second hooking arm welded to the guiding connector; and f) a pivot connector including a crimped portion, a first trunnion holder, and a second trunnion holder, wherein the pivot connector is crimped to the second end of the body.

2. The fuse cutout assembly of claim 1, further comprising:

a) a first angled surface and a second angled surface located between the fuse side and the mounting side of the body.

3. The fuse cutout assembly of claim 1, wherein the first end and the second end of the body have a reduced cross-sectional profile.

4. The fuse cutout assembly of claim 3, wherein the reduced cross-sectional profile of the body is configured, at least in part, to flex.

5. The fuse cutout assembly of claim 3, wherein the reduced cross-sectional profile of the body is configured, at least in part, to allow the first end and the second end to extend away from each other.

6. The fuse cutout assembly of claim 1, wherein the body has a rectangular cross-section.

7. The fuse cutout assembly of claim 1, wherein the body has a circular cross-section.

8. The fuse-cutout assembly of claim 1, wherein the fuse side of the body is curved.

9. The fuse-cutout assembly of claim 1, wherein the body is hexagonal in shape.

10. The fuse-cutout assembly of claim 1, wherein the body is rectangular in shape.

11. The fuse-cutout assembly of claim 1, wherein the body is octagonal in shape.

12. The fuse cutout assembly of claim 1, further comprising:

a) a first arm on the body provided with a generally straight portion extending from a midpoint of the body to the first end;

b) a first angled portion extending from the generally straight portion;

c) a second angled portion extending from the first angled portion;

d) a third angled portion extending from the second angled portion;

e) a fourth angled portion extending from the third angled portion; and f) a fifth angled portion extending from the fourth angled portion.

13. The fuse cutout assembly of claim 9, further comprising:

a) a second arm on the body provided with a second generally straight portion extending from the midpoint of the body to the second end;

b) a sixth angled portion extending from the second generally straight portion;

c) a seventh angled portion extending from the sixth angled portion;

d) a eight angled portion extending from the seventh angled portion;

e) a ninth angled portion extending from the eight angled portion; and f) a tenth angled portion extending from the ninth angled portion.

14. The fuse cutout assembly of claim 1, wherein the mounting connector and pivot connector are fabricated from 1010 grade steel.

* * * * *